US007661954B2

(12) United States Patent
Harneit

(10) Patent No.: US 7,661,954 B2
(45) Date of Patent: Feb. 16, 2010

(54) GAS BURNER

(76) Inventor: Uwe Harneit, 1466 W. Francis Ave., Ontario, CA (US) 91762-6016

( * ) Notice: Subject to any disclaimer, the term of this patent is extended or adjusted under 35 U.S.C. 154(b) by 99 days.

(21) Appl. No.: 11/518,698

(22) Filed: Sep. 11, 2006

(65) Prior Publication Data

US 2007/0218414 A1 Sep. 20, 2007

Related U.S. Application Data

(60) Provisional application No. 60/717,118, filed on Sep. 13, 2005.

(51) Int. Cl.
*F23D 14/64* (2006.01)
*F23D 14/20* (2006.01)
*F23D 14/62* (2006.01)
*F23D 14/84* (2006.01)

(52) U.S. Cl. ..... 431/278; 431/279; 431/284; 431/354

(58) Field of Classification Search ..... 431/278, 431/1, 8, 12, 39, 115, 181, 187, 326, 328, 431/347, 350, 351, 353, 354, 264; 126/1 R, 126/39 R, 92 R, 512; 99/324, 339, 341, 444, 99/447, 450

See application file for complete search history.

(56) References Cited

U.S. PATENT DOCUMENTS 5,002,038 A * 3/1991 Riehl ..... 126/39 R
5,149,262 A * 9/1992 Riehl ..... 431/258
5,401,164 A * 3/1995 Yen ..... 431/354
5,443,380 A * 8/1995 Riehl ..... 431/266
5,468,145 A * 11/1995 Ferlin ..... 431/266
5,740,789 A * 4/1998 Chang ..... 126/39 R
5,924,860 A * 7/1999 Massey et al. ..... 431/266
6,067,978 A 5/2000 Schlosser et al.
6,132,205 A * 10/2000 Harneit ..... 431/354
6,322,354 B1 * 11/2001 Carbone et al. ..... 431/284
6,325,619 B2 * 12/2001 Dane ..... 431/284
6,589,046 B2 * 7/2003 Harneit ..... 431/266
6,679,699 B2 1/2004 Yam et al.
6,688,882 B1 * 2/2004 Williams ..... 431/354
6,712,605 B2 3/2004 Moresco
6,736,631 B2 5/2004 Ferlin et al.
6,742,514 B1 * 6/2004 Eastman, II ..... 126/38
6,764,303 B2 * 7/2004 Dane et al. ..... 431/354

(Continued)

*Primary Examiner*—Steven B McAllister
*Assistant Examiner*—Daniel E Namay
(74) *Attorney, Agent, or Firm*—Lewis M. Brande; Thomas A. McCleary; Brande and McCleary

(57) ABSTRACT

This invention describes an improved gas burner assembly that can be adapted to attach to a range top or cooktop, or the floor of the range and can draw air from either above the range top level by external vents or from below range top level through an open style mixing cup. The invention uses a plurality of different flame rings to provide the user a wide variety of temperature settings starting from a low intensity simmer to high intensity cooking heat. The gas burner also utilizes a cover plate of transparent or translucent, heat proof material that allows the user to observe the interior of the burner to see if any of the flame rings have been ignited. The cover plate also transfers heat from the internal flame rings to the cooking utensil which provides a more uniform transfer of heat to the utensil.

34 Claims, 15 Drawing Sheets

U.S. PATENT DOCUMENTS

| | | | | |
|---|---|---|---|---|
| 6,780,009 | B2 | 8/2004 | Harneit | |
| 6,830,045 | B2 | 12/2004 | Brock et al. | |
| 6,951,455 | B2 | 10/2005 | Goldman | |
| 6,991,454 | B2 | 1/2006 | Gore et al. | |
| 7,040,890 | B2 | 5/2006 | Todoli et al. | |
| 2002/0034713 | A1 * | 3/2002 | Harneit et al. | 431/266 |
| 2004/0224273 | A1 * | 11/2004 | Inomata | 431/354 |

* cited by examiner

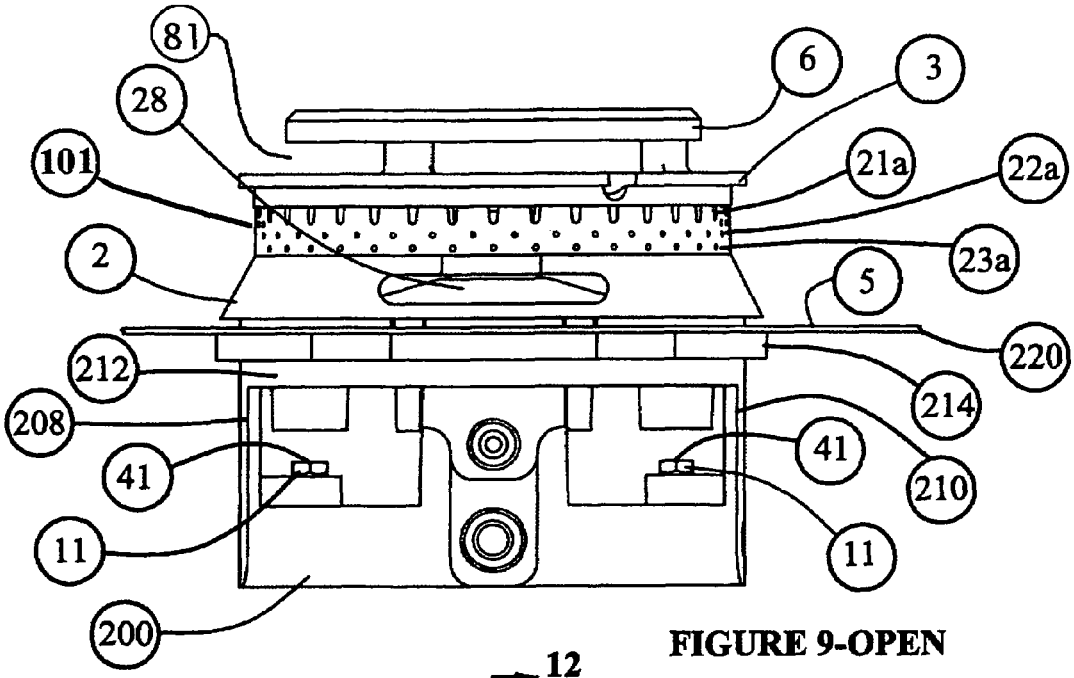
FIGURE 9-OPEN
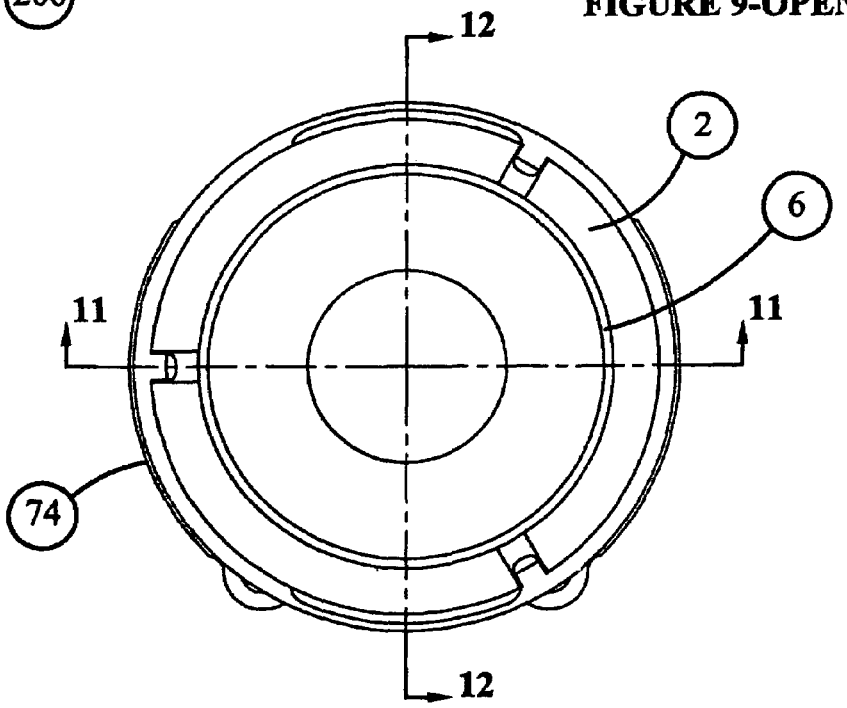
FIGURE 10

GAS BURNER

PRIORITY

This application claims priority for Provisional Application 60/717,118.

BACKGROUND OF THE INVENTION

Field of the Invention

This invention relates to the field of gas burners that are used in the home. Specifically, these burners are used in home appliances that in most cases have oven ranges.

SUMMARY OF THE INVENTION

Gas burners generally come in different sizes. The size generally will define the maximum BTU output of the gas burner. Depending upon the design of the flame rings of the specific burners, gas burners generally have a maximum output of approximately 15,000 BTU's (British Thermal Units), and have a diameter of approximately 4 inches (102 mm). The maximum BTU output is also governed by the flame density of the burner ring, or the ring that has the holes for the flame. The current state of the art in gas burners has a low intensity (low BTU output) gas burner that is regulated only by the amount of fuel/air mixture that is allowed through the flame ring. There may be a low BTU flame ring, but generally it provides a BTU output greater than 1000 B, and is generally unstable due to the low pressure of the gas-air mixture. The present invention uses a separate secondary flame ring that is centrally located within the burner assembly and is not part of the main burner assembly. The secondary flame ring is much smaller than the main flame ring and produces a maximum of 850 BTU's but also has extremely fine control, allowing the user to be very precise in the use of the flame, preventing the burning of delicate foods. The fine control of the secondary flame ring also allows for much lower BTU output, which will prevent burning of cooked foods that are being kept warm. A burner cover is placed over the main and secondary flame rings to more evenly distribute the heat. The burner cover may have a transparent heat resistant insert that allows the cook to verify whether the flames have been extinguished or are still ignited.

The burner is mounted on top of an appliance and does not use the air within the appliance. This internal air is used for the range or oven. By not using the internal air of the oven or range, the air pressure spikes caused by a user shutting the oven door is prevented, thereby preventing the extinguishing of the flame on the burners.

It is therefore one object of this invention to provide manufacturers with a top mounted gas burner that has no passages that allow liquids or solids to fall into the internal areas of the oven or range.

It is another object of the invention to provide a gas burner that has a high BTU output (>18,000 BTU's) at a smaller diameter (100 mm or—4 inches), creating more useable space on the cooktop.

It is a further object of the invention to provide the user with a gas burner that has a much greater range of BTU output and with finer control of the BTU output.

Another object of the invention is to provide the user with a gas burner that does not use the air that is internal to the gas oven/range, which will eliminate air spikes caused by closing the oven and ultimately extinguish the main or secondary flames.

A further object of the invention is to provide the user with a gas burner that has a burner cap that contains a heat resistant transparent portion or translucent colored portion, that allows the cook to see the flame of the low intensity or secondary burner, which will alert the cook that the burner is in use.

Other objects, advantages, and novel features of the present invention will become apparent from the following detailed description of the invention when considered in conjunction with the drawings appended claims accompanying the patent.

Description of the Prior Art

U.S. Pat. No. 7,040,890 B2 by Silvano Todoli May 9, 2006 describes a gas burner for domestic cooking appliances with a bowl-shaped body, a toothed crown with a plurality of flame ports and an upper cap. There is no mention of five flame rings, as in the current invention nor is there mention of a transparent, heat resistance portion of the burner cap, as in the current invention.

U.S. Pat. No. 6,991,454 B2 by Gore et al. Jan. 31, 2006 reveals a gas burner that simulates a wood burning fire, including a glowing ember effect. The current invention is designed for a conventional oven or range, not for a fireplace.

U.S. Pat. No. 6,951,455 B2 by Jacob Goldman Oct. 4, 2005 shows a system for utilizing a burner with pressurized gas and forced air to burn gas to provide heat for heating and drying purposes such as industrial kilns and drying furnaces. Again, the current invention is used with a gas oven or range found in a kitchen.

U.S. Pat. No. 6,939,126 B2 by Michael Boyes, Sep. 6, 2005 entitled "Gas Burner" describes a gas burner for use in a domestic heating appliance. Prior such devices were fabricated using welds, which fail over prolonged use. The current invention is not used for such domestic heating applications.

U.S. Pat. No. 6,830,045 B2 by Eddie Brock entitled "Gas Burner Module for a Cooking Appliance" shows a gas burner module having a base structure preferably formed from stamped steel upon which is secured at least one gas burner element and a gas orifice defining member in a predetermined alignment. The gas burner module is adapted to be mounted in an oven cavity. The current invention is designed for use on a rangetop and is substantially more complex than the Brock patent.

U.S. Pat. No. 6,780,009 B2 by Uwe Harneit entitled "Gas Burner Head Assembly" is an earlier patent designed by the inventor of the current patent. This invention has a burner head, a burner cap and a burner base, the burner head having 2 flame rings and one primary jet. The current invention has more than one flame ring, 2 primary jets and one secondary jet.

U.S. Pat. No. 6,764,303 B2 by Bernard Dane, et al. Jul. 20, 2004 entitled "Gas burner for a Cooker" reveals a gas burner for a cooker with a burner head having a frustoconical peripheral side wall and a multiplicity of slots forming flame orifices. This invention attempts to use the geometry of the frustoconical peripheral side to create two operating modes on the burner-a low setting whereby the small flames remain contained beneath the cap and heat the cap to allow heat transfer to the cooking vessel and a normal or high setting where the flames go around the cap and heat the cooking vessel directly. The current invention has several levels of settings due to the multiple flame rings not taught by this invention.

U.S. Pat. No. 6,736,631 by William Ferlin, et al. May 18, 2004 entitled "Sealed Gas Burner" teaches a sealed gas burner for a cooking range that has a venturi tube assembly which is attached directly to a range top of a cooking range. A burner cap releasably engages the burner cup and defines a plurality of burner ports. The burner ports can be cleaned by removing only the burner cap. This burner appears to only have one flame ring versus at least one main flame ring, and at least 2 secondary flame rings on the current invention. This invention is also permanently mounted to the range top, whereas the current invention can be removed.

U.S. Pat. No. 6,712,605 B2 by Paolo Moresco Mar. 30, 2004 entitled "Gas Burner for a Cooking Hob" shows a gas burner for a cooking hob that comprises a burner body with a plurality of openings for air; a flame dividing element which defines a gas injector, in conjunction with the burner body and air/gas mixing chamber, for injecting gas into the mixing chamber and a converging/diverging duct that defines a Venturi tube downstream of the gas injector for drawing air into the mixing chamber. The burner body, the flame-dividing element and the converging/diverging duct are in the form of a pressed sheet-metal casing. The current invention differs from this invention by consisting of a mixing cup, a burner base with at least one main flame ring, and at least 2 secondary flame rings and a burner cap, all of which are fabricated as separate components.

U.S. Pat. No. 6,679,699 B2 by Bernard Dane, et. al. Jan. 20, 2004 entitled "Gas burner for a Cooker" is similar to U.S. Pat. No. 6,764,303 B2 by Bernard Dane, et. al. Jul. 20, 2004 entitled "Gas burner for a Cooker" mentioned above by the same inventor. This invention also is limited to fewer settings than the current invention as mentioned supra.

U.S. Pat. No. 6,132,205 by Uwe Harneit by the same inventor as the current invention, describes a burner assembly with 3 flame rings and easy replacement of the gas jets without having to remove the unit from the appliance. The current invention is an improvement on this burner by including more flame rings and a see through window on top of the burner so a cook can see if the burner is active.

U.S. Pat. No. 6,067,978 by Erich J. Schlosser et al. May 30, 2000 entitled "Outdoor Cooking Apparatus with Improved Auxiliary Gas Burner" is an invention for a complete barbeque grill comprising a grilling housing and a gas burner mounted adjacent the grilling housing. The gas burner includes a burner base having a base chamber, a burner head having at least one air and fuel mixture exit port and venturii providing a passage between the burner head and the burner base for the air/fuel mixture. The current invention incorporates at least one main, and at least 2 secondary sets of holes for the flame rings. Also the current invention does not have a see through port on its burner cap as does the current invention.

BRIEF DESCRIPTION OF THE DRAWINGS

The invention is better understood by studying the cited embodiment illustrated in the appended drawings. These drawings depict only typical embodiments of the invention and are not therefore to be considered to be limiting of its scope. The invention will be described and explained with additional specificity and detail through the use of the accompanying drawings:

Figure one shows an exploded view of the top flow burner assembly;

Figure 20:
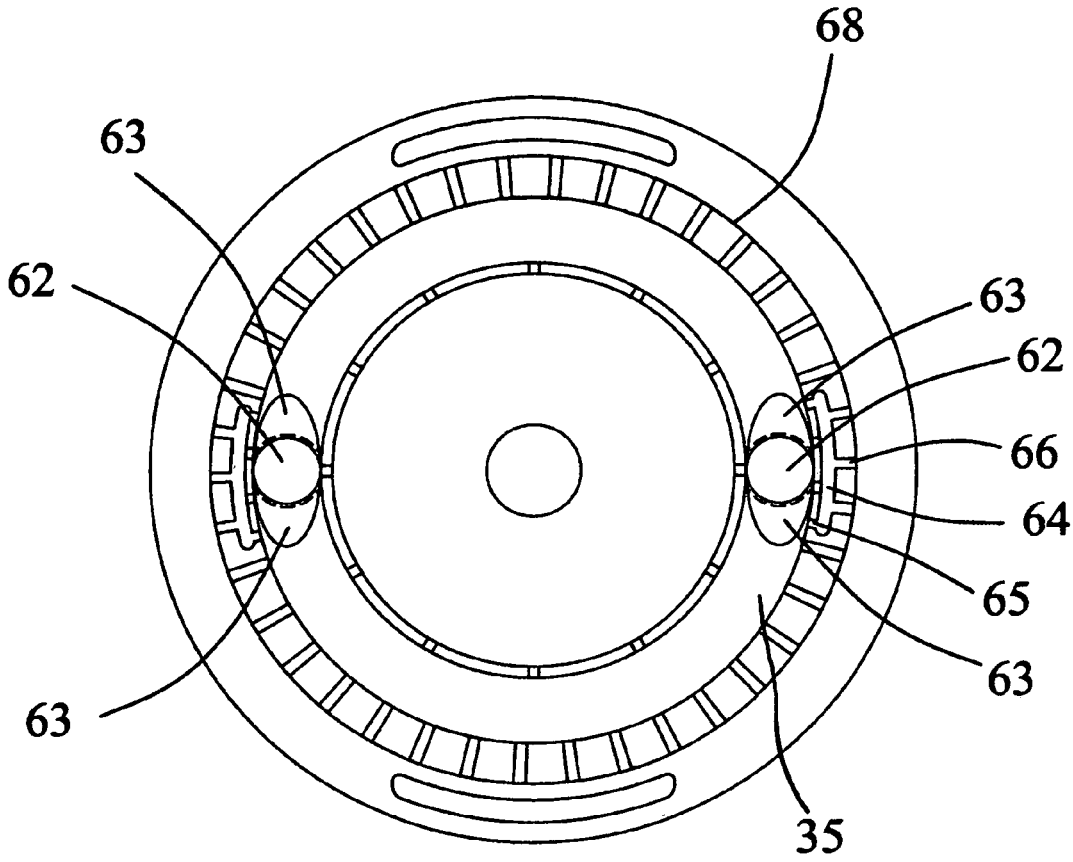

Figure two shows a side view of the top flow burner assembly;

Figure three shows a top view of the top flow burner assembly;

Figure four shows a first cross section of the top flow burner assembly;

Figure five shows a second cross section of the top flow burner assembly;

Figure six shows a perspective view of the internal structure of the mixing cup of the top flow burner assembly;

Figure seven shows the flame ring intensity;

Figure eight shows an exploded view of the bottom flow burner assembly;

Figure nine shows a side view of the bottom flow burner assembly;

Figure ten shows a top view of the bottom flow burner assembly;

Figure eleven shows a first cross section of the bottom flow burner assembly;

Figure twelve shows a second cross section of the bottom flow burner assembly;

Figure thirteen shows a detail view of the burner cap and burner base interface and flame rings;

Figure fourteen shows a perspective view of the bottom flow burner cup;

Figure fifteen shows a bottom view of the burner base in perspective;

Figure sixteen shows a side view of the burner base;

Figure seventeen shows a top view of the burner base;

Figure eighteen shows a bottom perspective view of the secondary burner;

Figure nineteen shows a side view of the secondary burner;

FIG. 20 shows a top view of the burner base.

DETAILED DESCRIPTION

Figure 1:
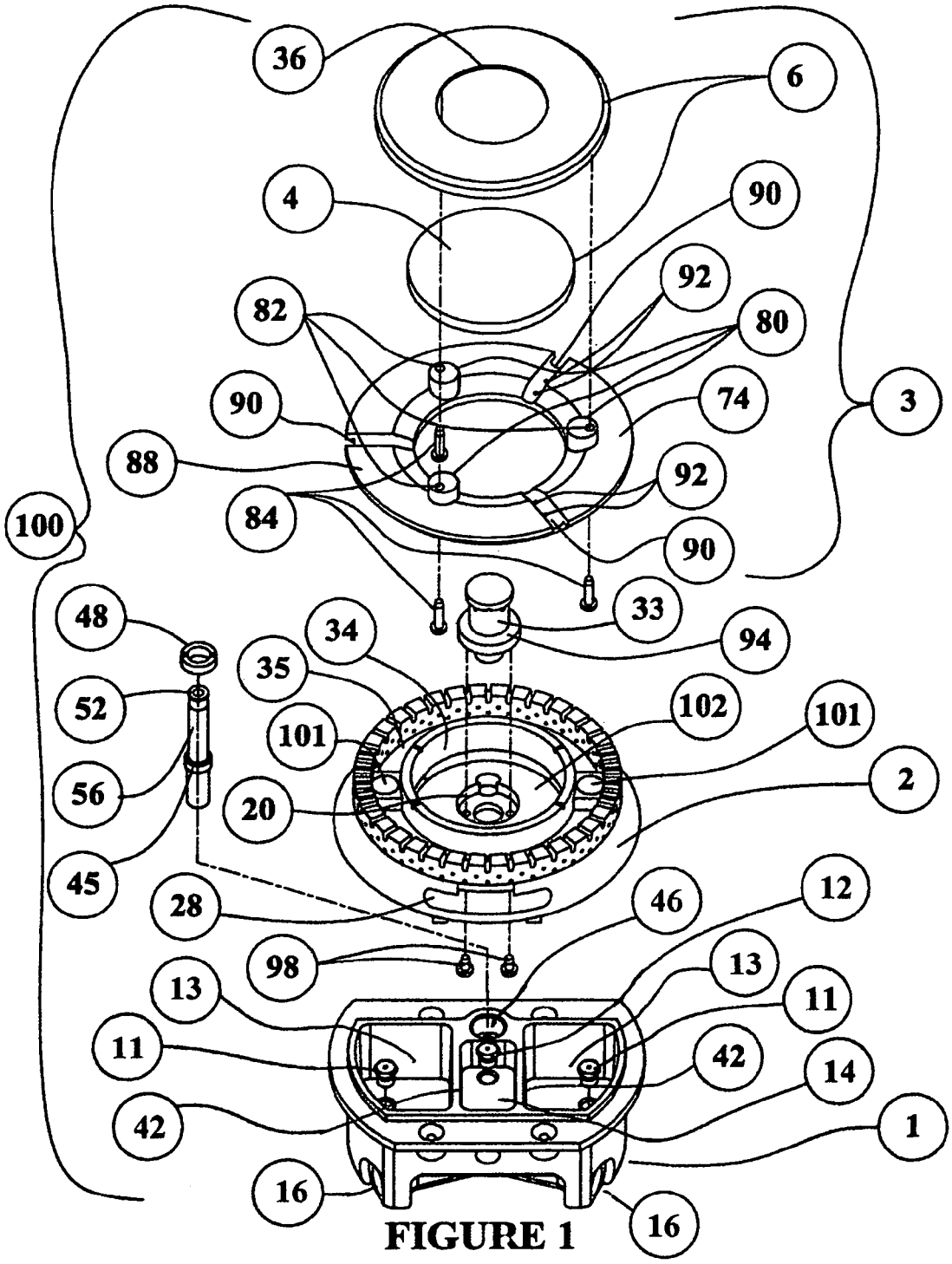
Figure 2:
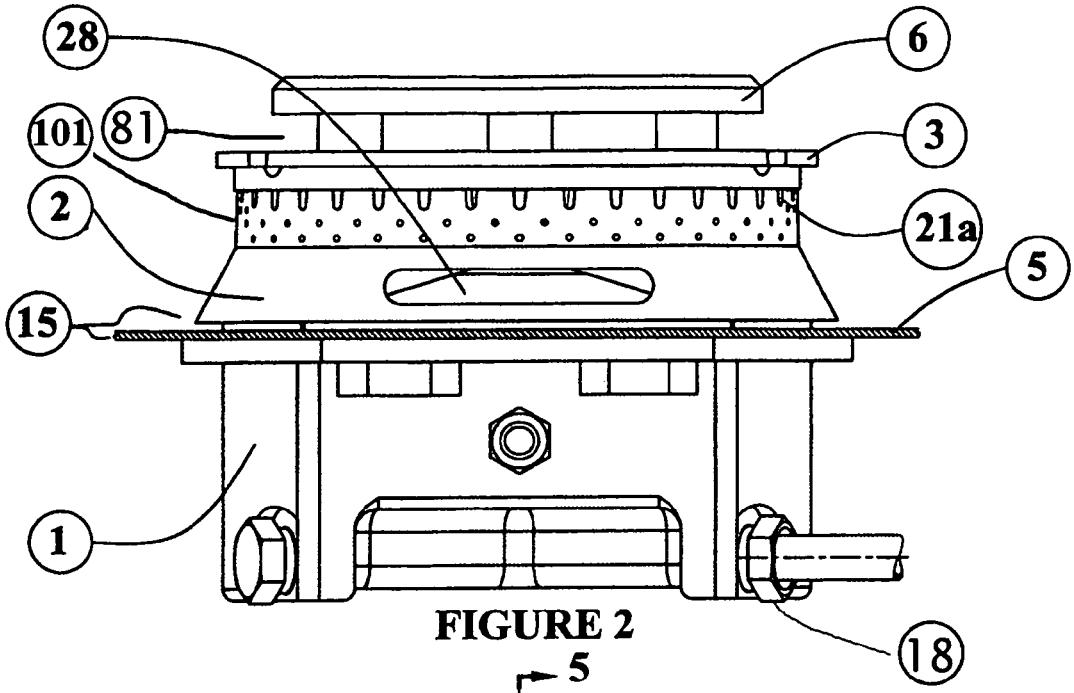
Figure 3:
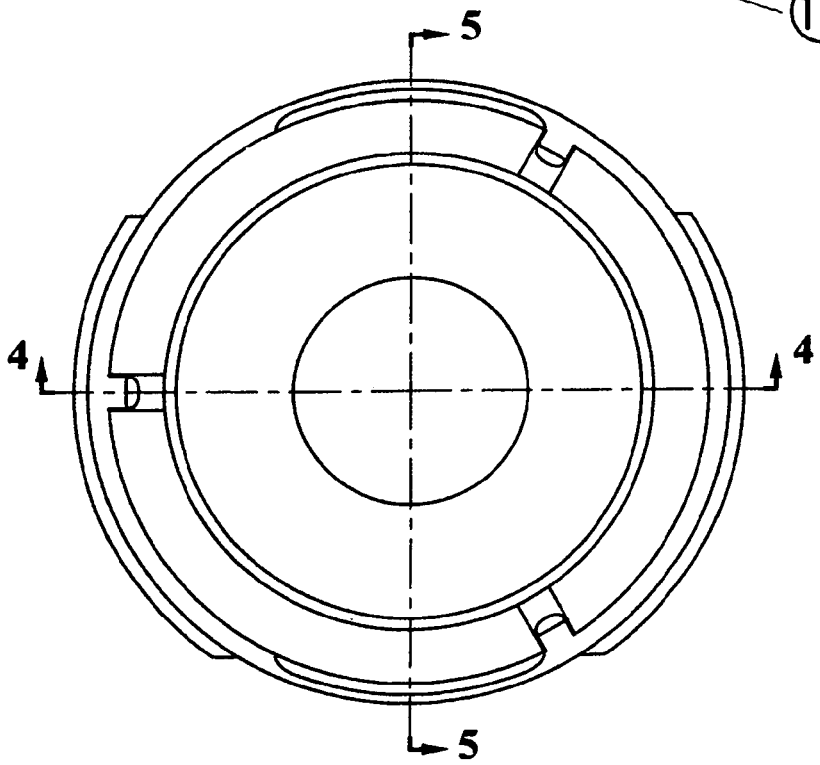
Figure 13:
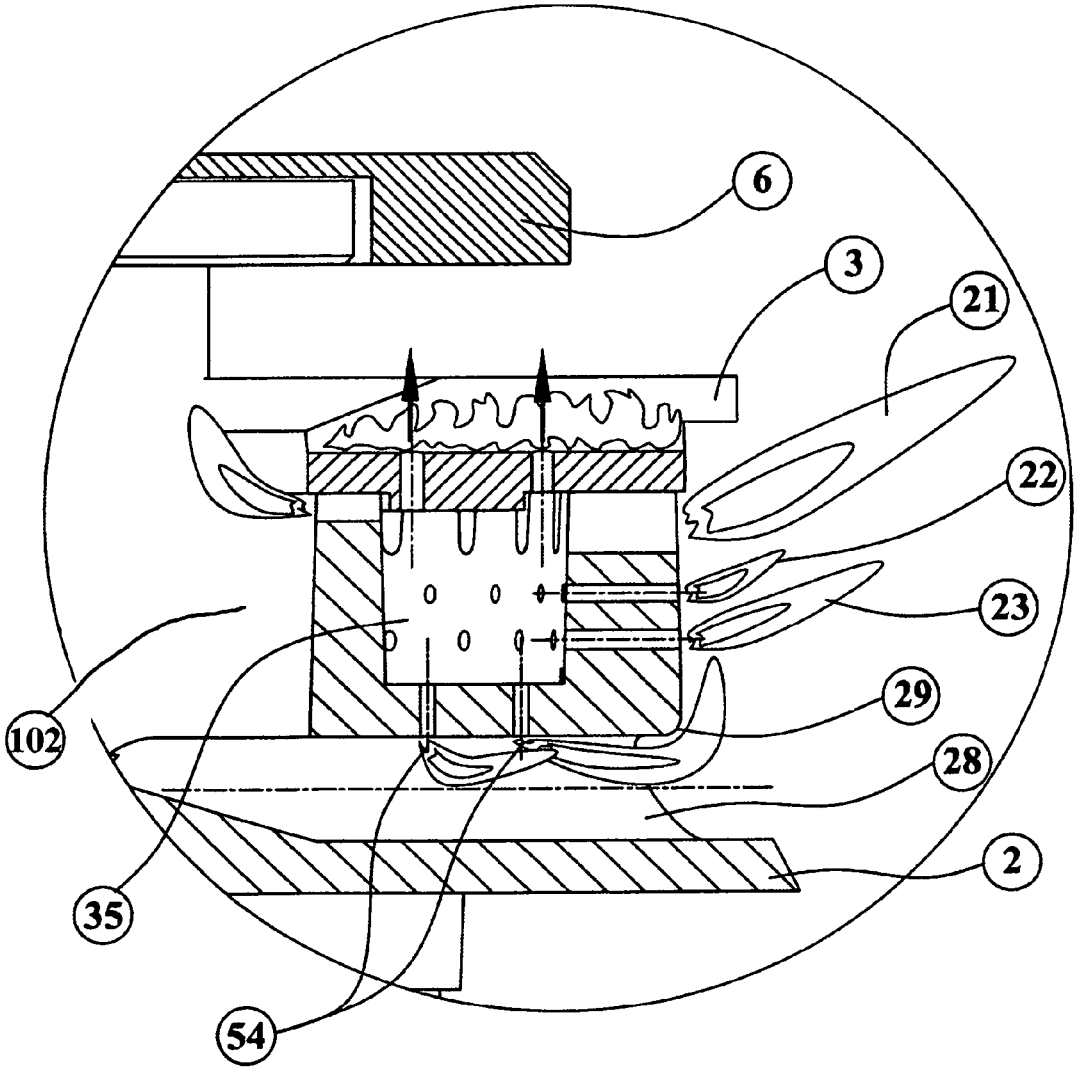
Figure 14:
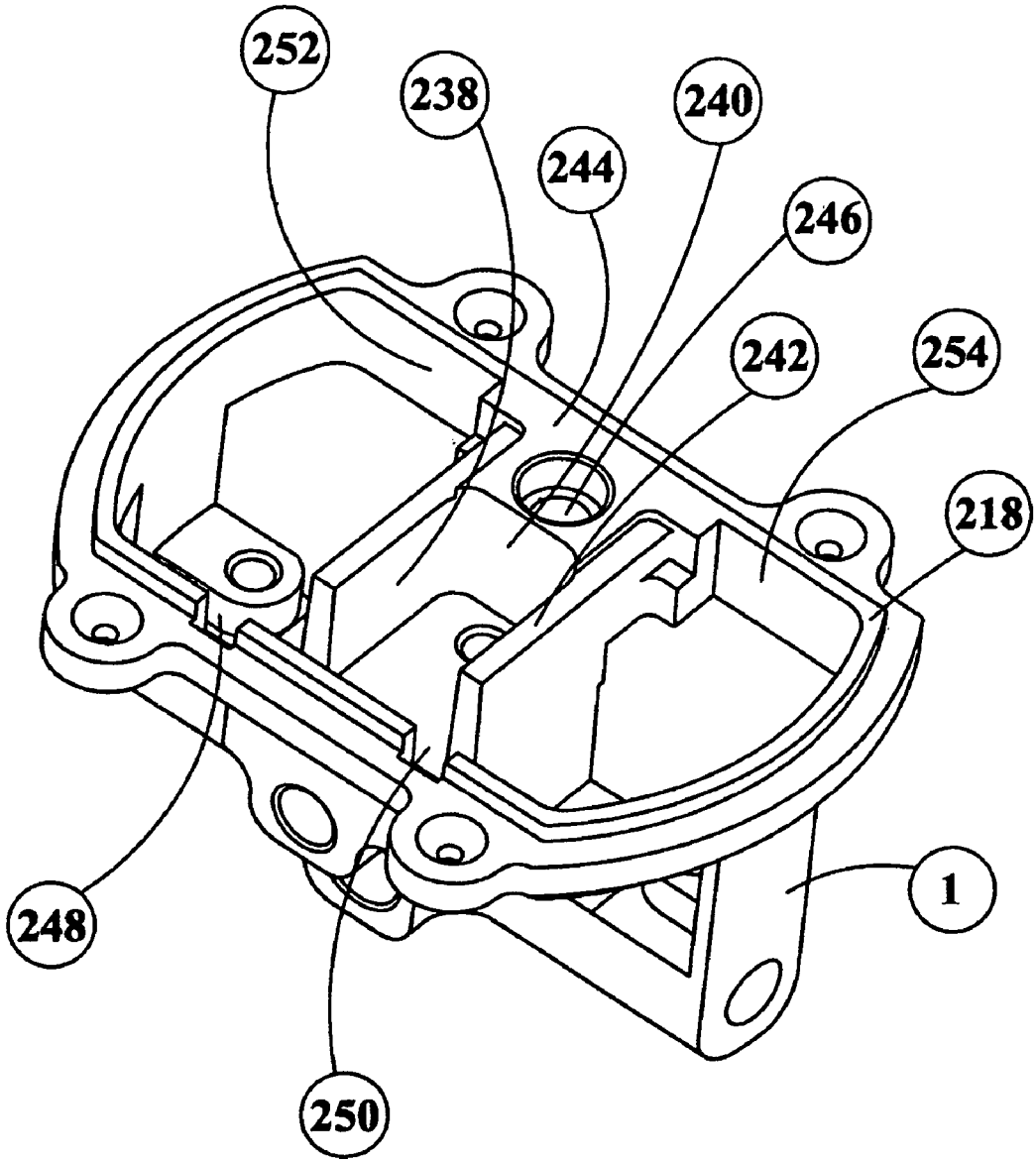
Figure 15:
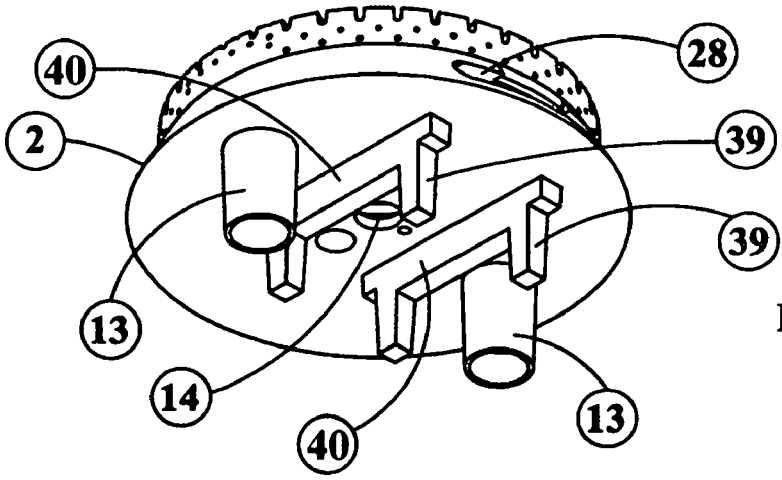
Figure 16:
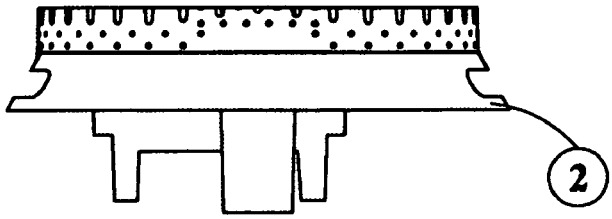
Figure 17:
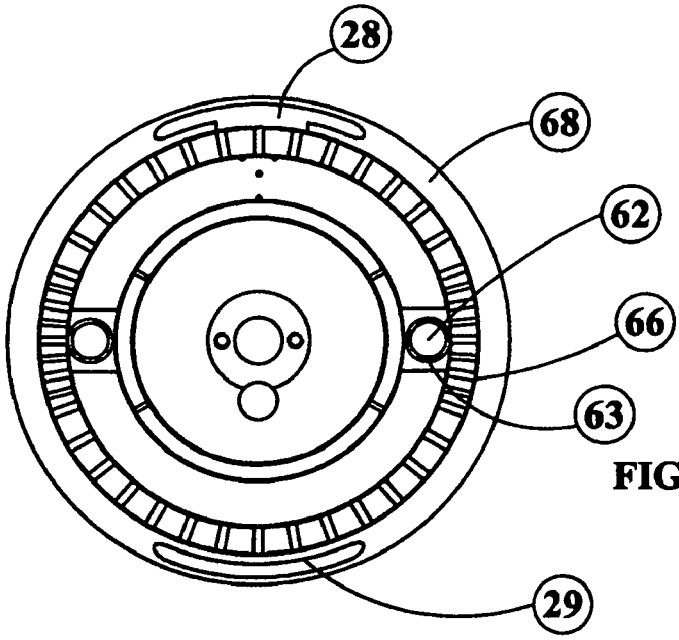
Figure 18:
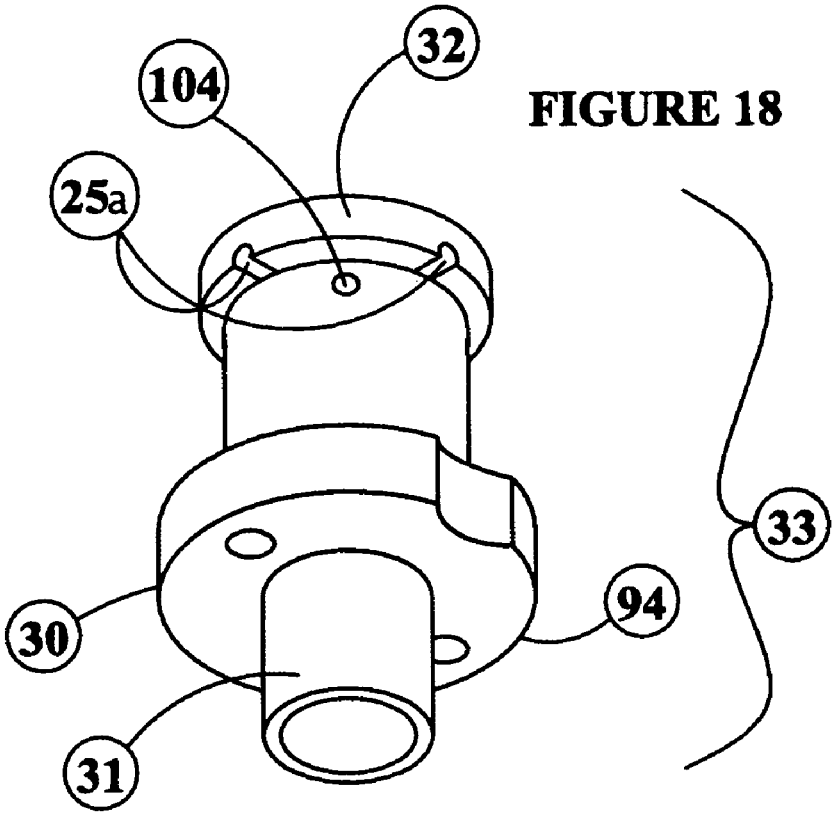
Figure 19:
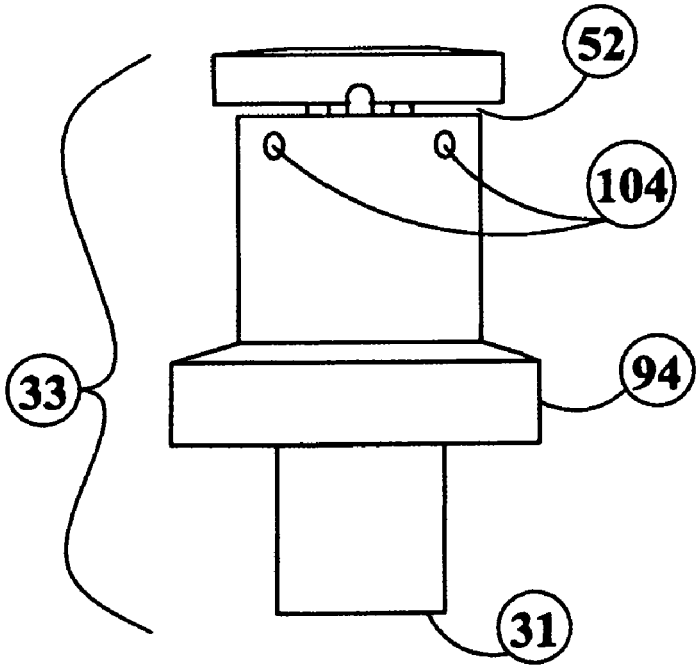

FIG. 1 shows an exploded view of the gas burner assembly or burner assembly (100). With respect to FIG. 1, a gas burner assembly (100) is shown. The gas burner assembly (100) consists of a mixing cup (1). In FIGS. 2, 4, 5 and 8 the mixing cup (1) is generally attached either to a transverse member (7) of an appliance or the base and/or the top (5) of the appliance. A burner base (2) is shown resting on the mixing cup (1). The burner base (2) is offset from the mixing cup (1) creating an open air passage or primary air slot (15). The primary air slot (15) allows air into a primary air inlet chamber (9). The present invention shows that there are at least two primary air inlet chambers (9) that feed a main burner chamber (35) that feed a first, second, third and fourth flame ring (21,22,23,24, respectively) as shown in FIG. 13.

A cover plate (6) is mounted on top of a burner cap (3). The number of flame rings that are necessary on the outer wall (101) of the main burner chamber (35) can be modified so as to provide the proper BTU capacity by revising the cross sectional area of the first slot or hole (21*a*) for the main flame ring (21). In all cases there must be at least one flame ring or slot (21) that provides the high intensity BTU requirement. The burner base (2) is shown having a protruding edge (27) wherein the protruding edge (27) directs debris and spillover from cooking away from the mixing cup (1) and onto the appliance top (5).

Figure six shows the two primary air inlet chambers (9), which are located in the outer portions of the mixing cup (1). The mixing cup (1) has a gas supply tube (16) defined in the bottom portion of the mixing cup (1). A gas supply line (17) is shown attached to one end of the gas supply tube (16) and provides flammable gas. The opposing end of the gas supply tube (16) is shown having a plug (19) closing off the gas supply tube (16). At least two main gas jets (11) are shown communicating with the gas supply tube (16) allowing the fuel, in this case natural gas, to pass therethrough and into the primary inlet chamber (9). Since common construction of the main gas jets (11) have the sizes of the orifices or primary gas flow openings (41) small in diameter, the velocity of the incoming fuel causes a low pressure zone thereby suctioning the surrounding air and mixing it with the fuel.

Figure 4:
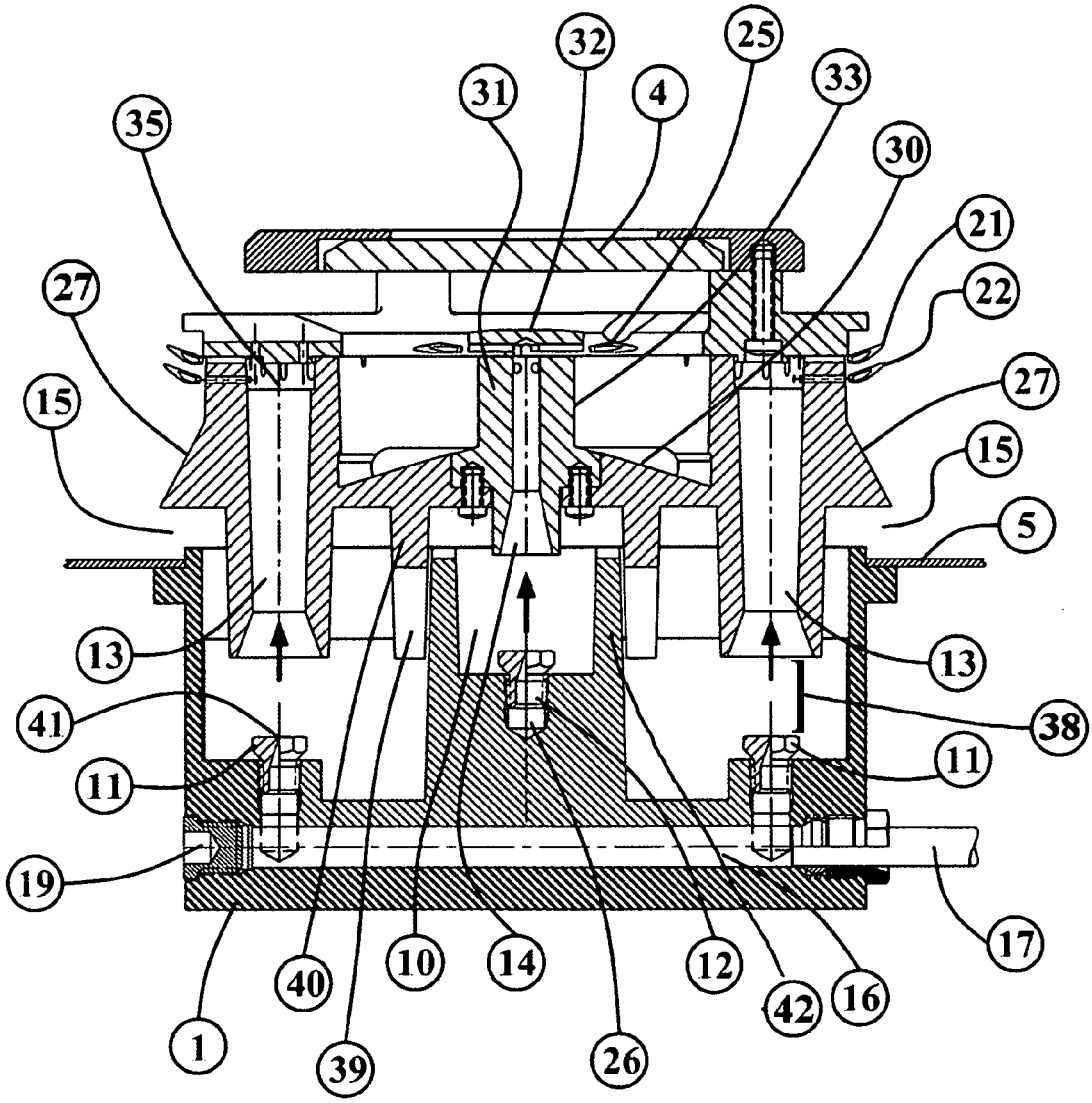
Figure 5:
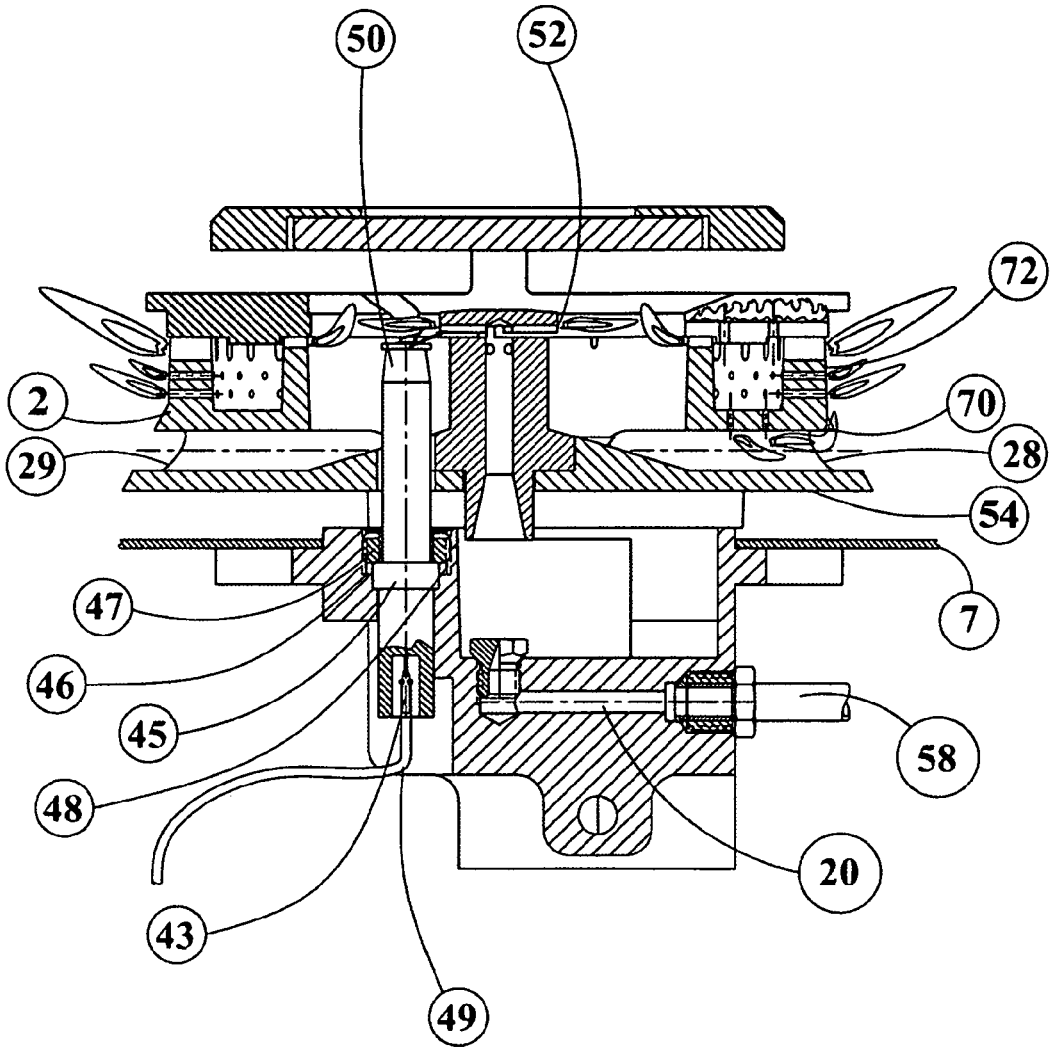
Figure 6:
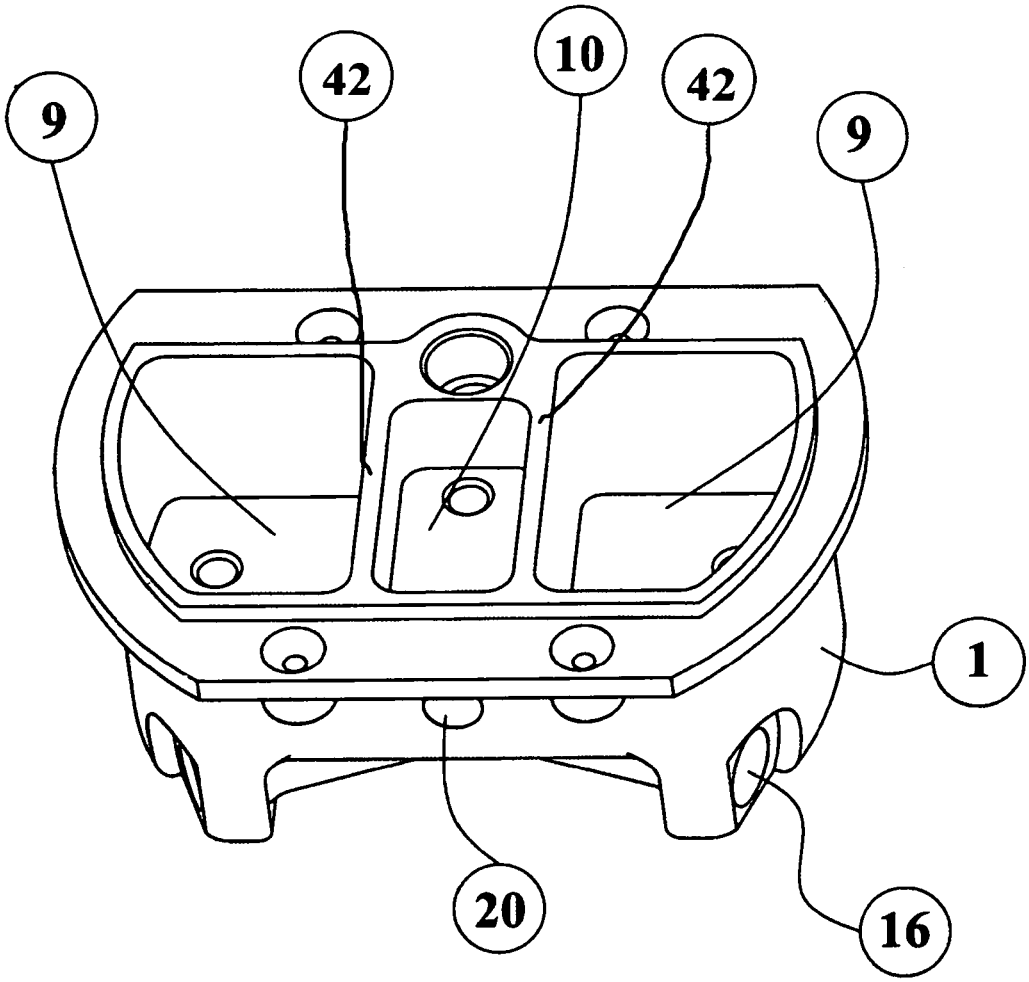
Figure 7:
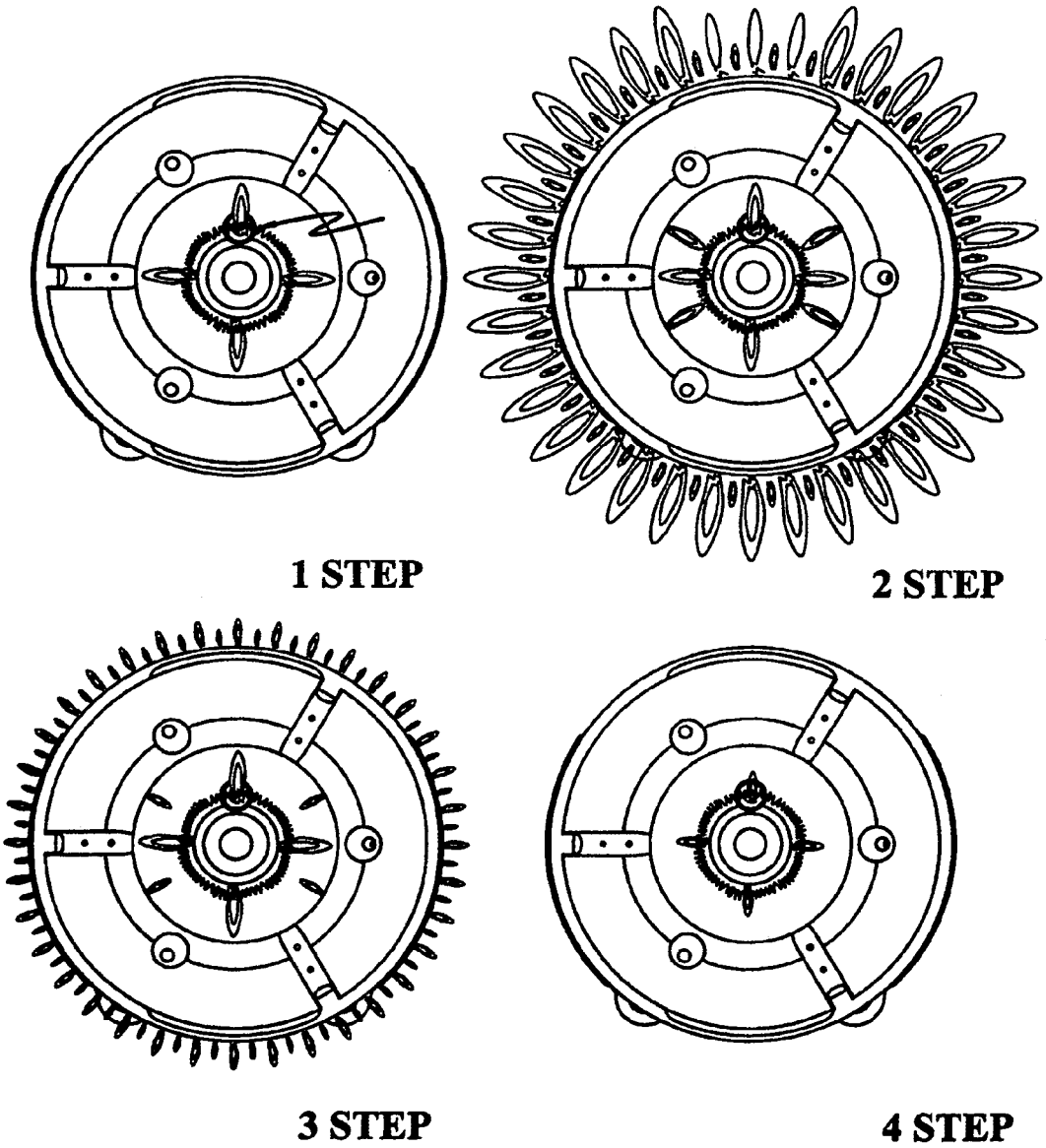

In FIG. 4 positioned above each primary gas jet (11) is a primary gas mixing chamber (13). The primary gas mixing chamber (13) is offsettedly placed above the primary jet (11) creating a gap (38) thereby allowing air to be mixed with the flammable gas therein. The primary gas mixing chamber (13) directs the fuel air mixture into a main burner chamber (35). The main burner chamber (35) may be any geometric shape, but as disclosed in the drawings of the instant invention, circular. An outer wall (101) of the main burner chamber (35) has at least a first series of holes (21*a*) creating at least a first flame ring (21). The drawings disclose a first, second, and third, series of holes (21*a*, 22*a*, 23*a*) creating a first, second, and third flame ring (21, 22, 23) defined therethrough. The first series of holes (21*a*) are larger than the second series (22*a*) and third series (23*a*) of holes and may be slots as shown in the drawings the slots or first series of holes (21*a*) being located on an upper portion (106) of the burner base (2). The first series of holes or slots (21*a*) provide for a flame that produces a higher BTU range than of the second and third series of holes (22*a*, 23*a*) alone.

The main burner chamber (35) has at least one fourth hole or slot (24*a*) defined on an inner wall (34), which creates a fourth flame ring (24). The fourth hole or slot (24*a*) is also located on the upper portion (106) of the burner base (2). The first, second, third, series of holes (21*a*, 22*a*, 23*a*), and fourth hole or slot (24*a*) all communicate with the main burner chamber (35) and provide a gas-air mixture to be ignited. The burner cap (3) is shaped similarly to the burner base (2) and covers the main burner chamber (35). The burner cap (3) therefore has a centrally located hole theredefined.

Interposed between the primary inlet chambers (9) is a secondary inlet chamber (10). A secondary gas transfer tube (20) is defined in the mixing cup (1) and communicates with the secondary gas supply line (58) and the secondary inlet chamber (10). The secondary gas transfer tube (20) is adapted to receive a secondary gas line (58) which provides flammable gas thereby. The mixing cup (1) is shown with a central hole (26) wherein the central hole (26) communicates with the secondary gas transfer tube (20) and the secondary inlet chamber (10). A secondary jet (12) is shown inserted into the secondary gas transfer tube (20). The present invention shows that the burner base (2) has a first and second secondary air slot (28, 29 respectively) defined therein. However, the burner base (2) may have one or more secondary air slots defined therein. The first and second secondary air slots (28, 29) allow food and debris to pass through. The burner base (2) further has a central cavity (102) defined therein, where the central cavity is surrounded by an inner wall (34) of the burner base (2). The central cavity (102) communicates with the surrounding atmosphere via at least one secondary air slot (28). The drawings disclose that the central cavity (102) communicates with the surrounding atmosphere via the first and second secondary air slots (28, 29 respectively). The secondary inlet chamber (10) draws main air from the primary air slot (15) previously defined. The secondary jet (12) is shown centrally positioned in the gas burner assembly (100).

A secondary burner (33) is structured as follows. A secondary transfer tube (31) is attached to a spherically convex base (30) and terminates in an end cap (32). The end cap (32) has a diameter larger than that of the secondary transfer tube (31). At the interface of the end cap (32) and the secondary transfer tube (31), a small groove (52) is defined therein. Additionally, at the interface of the end cap (32) and the secondary transfer tube (31) a fifth series of holes (25*a*) defining a fifth flame ring (25). There are at least 4 holes (25*a*) defined. The 4 holes (25*a*) communicate with the secondary transfer tube (31), and allow a fuel/air mixture to pass therethrough.

The secondary burner (33) additionally has a sixth series of holes (104) defined. The sixth series of holes (104) communicate with the gas transfer tube (31) and allow the fuel/air mixture to pass therethrough, adding to the fifth flame ring (25). The fuel/air mixture also is captured by the groove (52) creating a sustaining flame thereby. The secondary burner (33) is positioned over the secondary jet (12) and the secondary inlet chamber (10). With the end cap (32) having a diameter larger than the secondary transfer tube (31), the fifth series of holes (25*a*) and the small groove (52) located in the secondary transfer tube (31) will not be clogged with debris.

The secondary burner (33) has a ring (94) defined thereon, where the ring (94) fits within a corresponding hole (96) centrally defined within the burner base (2). The hole (96) is defined within a conical or spherically convex base (30). The conical or spherically convex base (30) allows liquid or solid debris to be carried from the secondary burner (33) to the appliance cook top (5) and not fall through into the oven/range. Fasteners (98) securely hold the secondary burner (33) onto the burner base (2).

The main burner chamber (35) is covered by the burner cap (3). The burner cap (3) is actually an assembly and comprises multiple parts. The burner cap (3) consists of a base (74), where the base (74) is the same shape as the burner base (2). The burner cap (3) is then securely placed upon the burner base (2) and provides a leak proof fit for the gas-air mixture. The burner cap (3) generally is made from a material dense enough to provide sufficient weight to the burner cap (3) to prevent inadvertent dislocation of the burner cap (3) from the burner base (2), and to prevent the pressure within the main burner chamber (35) from dislocating the burner cap (3).

The base (74) has a downward protruding boss (76) that is adapted to *fit inside an inner wall (34) of the main burner chamber (35) of the burner base (2) positionally locating the base. A plurality of upward protruding bosses (80) create a planar surface for the cover plate (6) to rest upon. The placement of the burner cap (3) on the bosses (80) creates a gap (81) between the cover plate (6) and the burner cap (3). Each boss (80) has a through hole (82) defined therethrough to allow each of a plurality of fasteners (84) to securely hold the cover plate (6) in place. The cover plate (6) may be shaped similar to the burner base (2) and additionally has a channel (36) defined therein, which would allow a burner insert (4) to rest therein. The burner insert (4) may be made as a complete metallic structure, or as the preferred embodiment a transparent or translucent heat resistant structure. The burner insert (4) is shown mounted upon the cover plate (6) allowing the cook to see if the flames are still burning.

An advantage of using the cover plate (6) is that no direct flame is used for cooking. The flame heats the cover plate (6) which then evenly heats the cookware, preventing any severe hot spots on the cookware. The base (74) has a top side (88). Spaced between the bosses (80) is at least one flame channel (90), where the flame channel (90) has at a plurality of through holes (92) defined therethrough. The through holes (92) communicate with the main burner chamber (35) and provide additional flame to the cookware. The present invention shows three (3) flame channels (90) spaced between the bosses (80).

The mixing cup (1) is equipped with vertical flanges (42) that separate the primary and secondary air inlet chambers (9, 10), and prevent them from drawing air from each other. The burner base (2) has vertical flanges (40) where each vertical flange (40) located on the burner base (2) has extensions (39) on their side edges that positionally locate the burner base (2) in the burner cup (1). The vertical flanges (40) and their extensions (39) of the burner base (2) reach into the primary air inlet chambers (9, 10) and prevent sideways tipping of the burner base (2) over the burner cup (1). The vertical flanges (40) and their extensions (39)) of the burner base (2) provide the secure centering of the primary jets (11) and therefore the primary gas flow opening (41), to the primary gas mixing chamber (13) and respectively the secondary jet (12) and secondary gas flow opening (44), to a secondary mixing chamber (14).

An ignition electrode (56) is inserted through the mixing cup (1) and the burner base (2) and positioned in close proximity to the end cap (32) of the secondary burner (33). The ignition electrode (56) is inserted from the top of the burner assembly (100) and an externally threaded nut (48) secures the ignition electrode (56) to the burner assembly (100). This allows the ignition electrode (56) to provide a spark to ignite the gas-air mixture exiting the secondary burner (33). Since the amount of gas-air mixture emerging through the transfer channels (52) is very small, these flames extinguish almost entirely after ignition.

The ignition electrode (56) has shoulder (45) with which it is set in a first stepped hole (46) from the upper side of the mixing cup (1). A second stepped hole (47) is located above the first stepped hole (46) with tapped threading. After the ignition electrode (56) is set in the first stepped hole (46), it is fastened with a slotted round nut (48). An ignition wire (49) running in the interior of the ignition electrode (56) has a pressed on terminal (43) on one side and on the upper side has an ignition plate (50). Material for the ignition wire (49) and the ignition plate (50) are plasma welded together and the same material is used for both of them.

Ignition wires (49) in electrodes that are found in the industry today, are partly fabricated from stainless steel. Stainless steel is known to be heat resistant to 1850° F. Another material commonly used for the ignition wires is ferritic FeCrAl alloy, which is known to be heat resistant to 2370° F. A well-known problem with stainless steel is that when stainless steel comes into contact with a salt solution, it begins to rust. Stainless steel is currently known to be used for the ignition plate (50) on "standard igniters." The standard method of construction used in the industry is to either rivet or weld the ignition plate (50) and the ignition wire (49) together.

It is known in the engineering and scientific communities that stainless steel and FeCrAl alloys have different coefficients of expansion. Because of this, the cycling of heat and cold will eventually break the weld and allow corrosion to form between the ignition plate (50) and the ignition wires (49). By using only high value FeCrAl alloy both for ignition wire (49) and ignition plate (50) (with a melting point of over 2700° F.) the ignition plate (50) and the ignition wire (49) are plasma welded together. This will prevent the current problem of the welds cracking due to different coefficients of expansion.

In order to prevent the flame exiting in close proximity of the primary gas mixing chamber (13) from larger than the surrounding flames, the burner base (2) must be modified. A gas-air transfer slot (64) is spaced between the gas-air outlets (66) located on the outer surface (68) and the inner surface (66*a*) of the burner base (2). The gas-air outlet slots (66) communicate with the gas-air transfer slot (64). Gas-air inlet slots (65) allow the main burner chamber (35) to communicate with the gas-air transfer slot (64). The gas-air inlet slots (65) are positionally offset from the gas-air outlets (66) in order to reduce the pressure gradient, thereby equalizing the outlet pressure of the gas-air mixture of first, second, and third flame rings (21, 22, 23 respectively). This creates flames of equal length around the entire outer surface (68) of the burner base (2).

Another method of equalizing the gas pressure is as follows. The burner base (2) has a boss (110) coincidentally located over each primary gas mixing chamber (13) thus raising the point that the flammable gas-air mixture enters the main burner chamber (35). The outer wall (101) of the main burner chamber (35) has a seventh series of holes or slots (112) defined therein. The seventh series of holes or slots (112) are located in close proximity to each boss (110). The seventh series of slots (112) have cross sectional areas that is less than that of the first series of slots or holes (21*a*) defined in the burner base (2). The seventh series of holes of slots (112) is also located towards the upper portion (106) of the burner base (2). Interspaced between each of the seventh series of slots (112) is an eighth series of slots or grooves (114), the eighth series of grooves (114) allowing a flammable gas-air mixture to exit the main burner chamber (35) and provide a continuous flame for the first flame ring (21). Situated below the eighth series of grooves (114) is a ninth series of holes (116). The ninth series of holes (116) provide additional flammable gas-air for the first flame ring (21). This makes the first flame ring (21) circumferentially continuous.

In order to provide for improved gas-air mixture, a primary gas-air mix cap (62) is offsettedly placed over each primary gas mixing chamber (13). This defines lateral outlets (63) for the gas-air mixture improving the distribution of the gas-air mixture within the main burner chamber (35).

In practice, the gas burner assembly (100) operates as follows. A user will turn the gas supply knob to a first position, allowing gas fuel to enter through the secondary gas transfer tube (20) and through the secondary jet (12) and the secondary inlet chamber (10) mixing with the air. The pressure from the gas line will allow the gas-air mixture to flow through the secondary transfer tube (31) and then be ignited at the fifth series of holes (25*a*) creating the fifth flame ring (25). This will create a very low BTU flame. As the user turns the gas supply knob further, the control knob will first be at a maximum setting where the gas fuel will flow into the gas supply tube (16), then through the main gas jets (11). The pressured gas will mix with the air in the primary air inlet chamber (9) and then be transferred through the primary gas mixing chamber (13). The emerging gas-air mixture for the fourth flame ring (24) is ignited by the fifth flame ring (25). The gas-air mixture will flow through the transfer channels (54) and allow a minute amount of the ignited gas-air mixture to exit into the first secondary air slot (28). The ignited gas-air mixture emerging through the transfer channels (54) passes through the first secondary air slot (28) to the outside of the burner base (2) and ignites the first, second and third flame rings (21, 22, 23 respectively) creating a high BTU flame. In order for the ignited gas-air mixture to subsequently ignite the first, second, and third flame rings (21, 22, 23 respectively) the flame must propagate with a smooth radiused transition (70) where the radiused transition (70) is located at a top portion (72) of the first secondary air slot (28) in close proximity to the transfer channels (54). This embodiment generally is mounted on a enclosed cook top. All air needed for the correct combustion of the gas mixture enters through the primary air slot (15). As the control knob is rotated, the amount of gas is reduced until a minimum setting is achieved, where in sequence the first second and third flame rings (21, 22, 23 respectively) are extinguished by lack of gas-air pressure, and finally the fourth flame ring (24) is extinguished due to a reduced gas-air setting.

Figure 11:
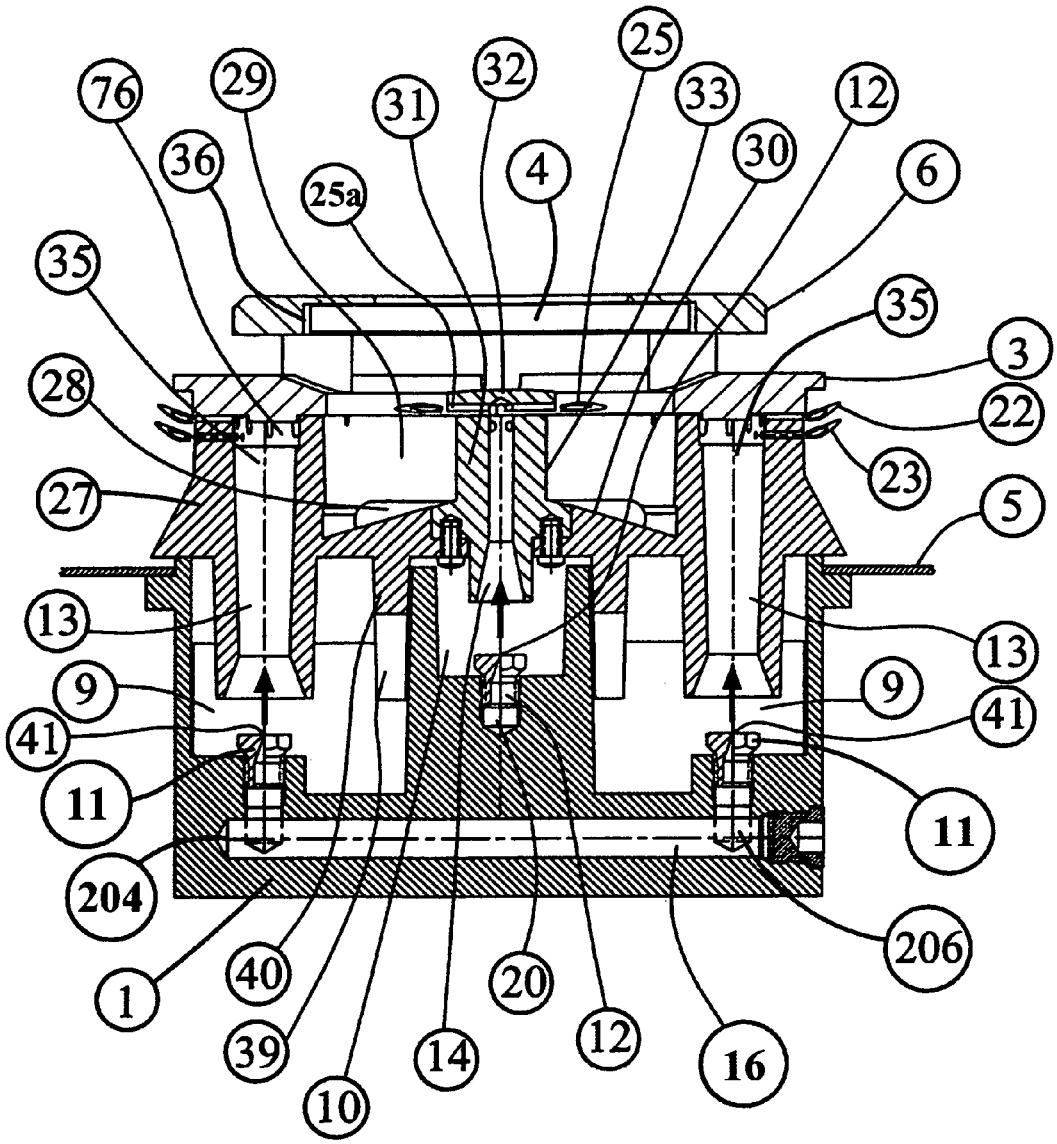
Figure 12:
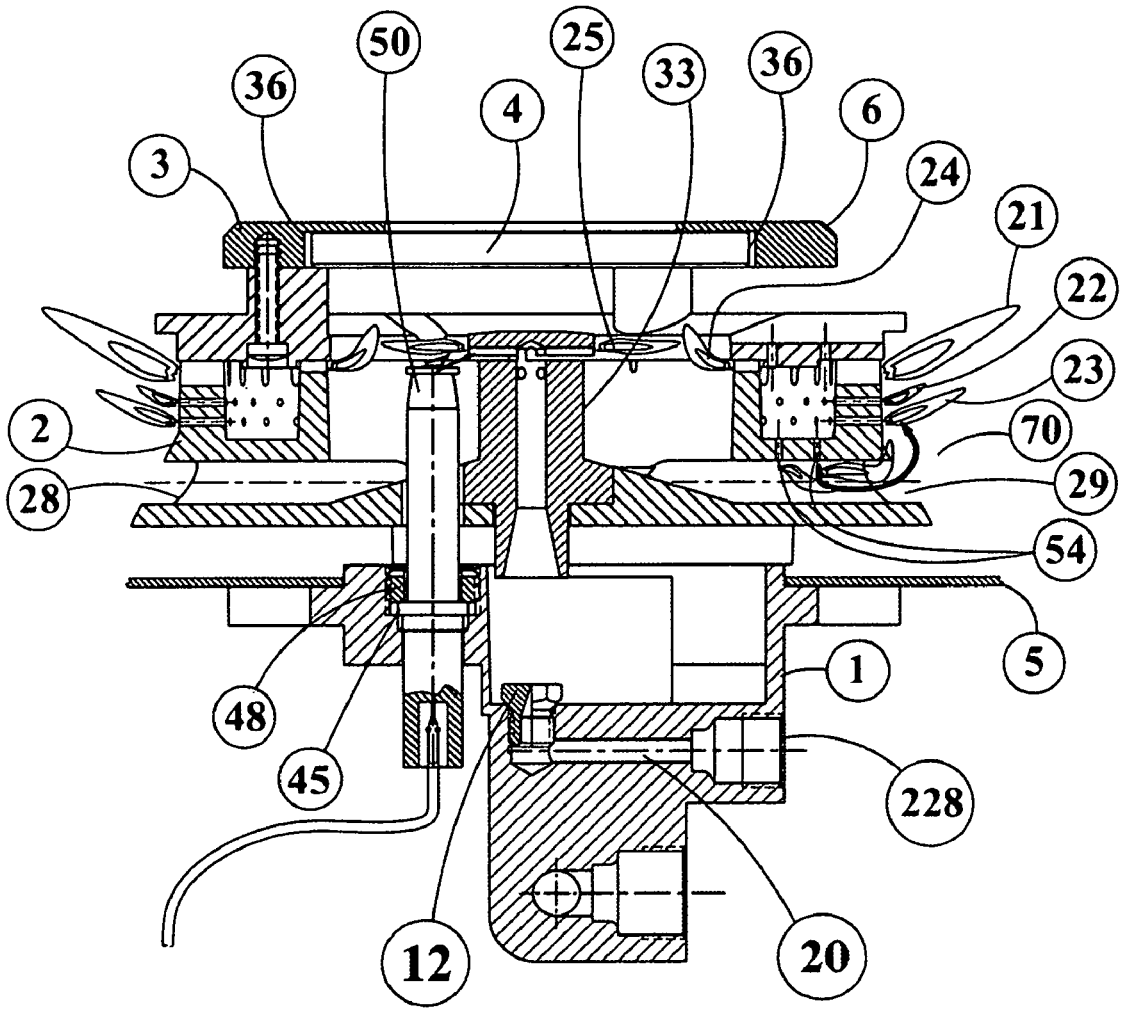

Another style of cook top allows air to flow from the top to the inside of the cooking device. As shown in FIG. 11, a mixing cup (1) is provided. The mixing cup (1) comprises the following elements. A gas supply line (16) is shown attached to a gas supply tube (16). The gas supply tube (16) is shown as linear. The gas supply tube (16) has a first end (204) and a second end (206).

Figure 8:
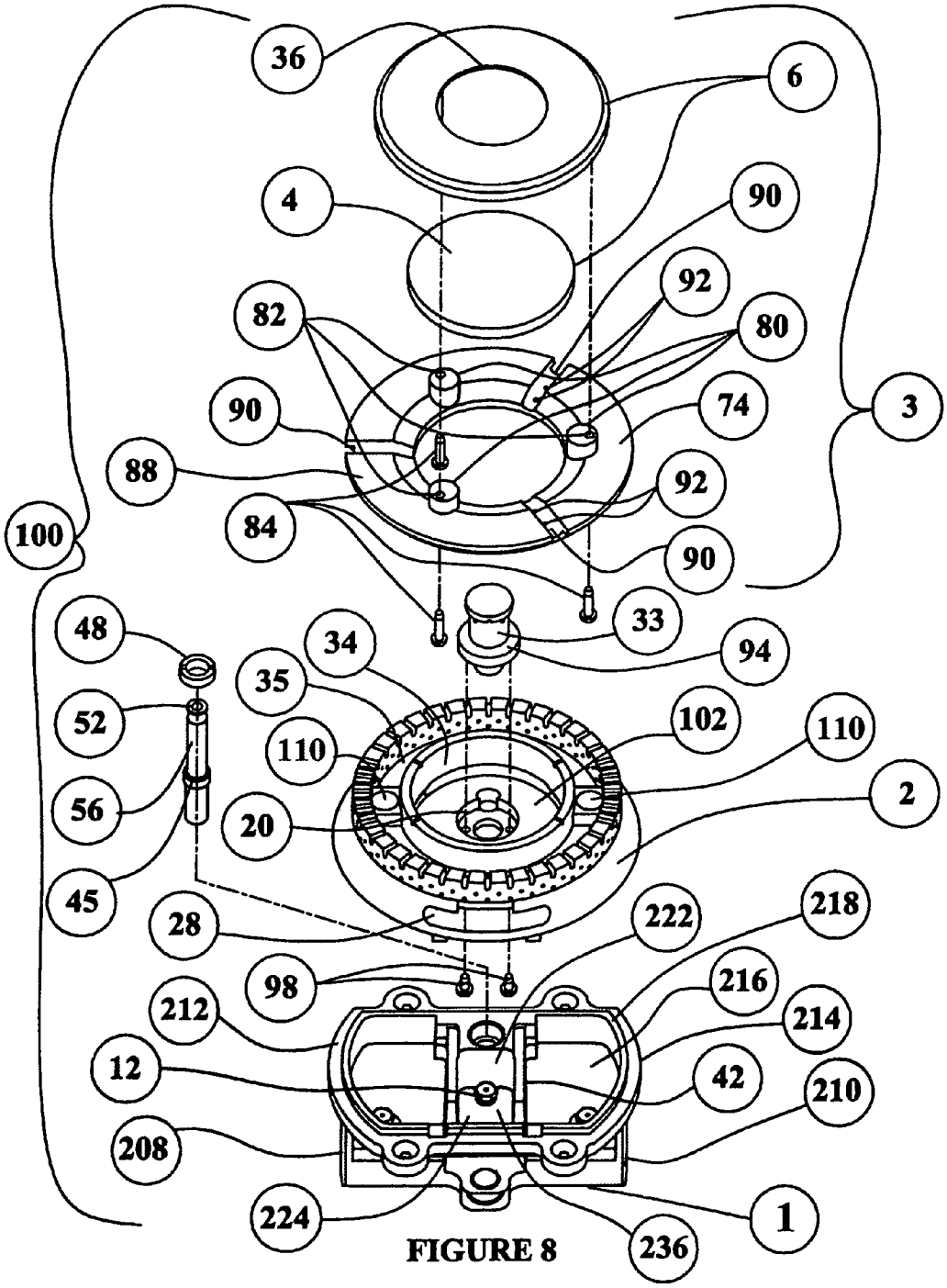

In FIGS. 8, 9, and 11 a first support (208) and a second support (210) are shown projecting upwards from the gas supply tube (16), and attaching to an attachment plate (212) where the attachment plate (212) has an outer perimeter (214) and an inner open cavity (216) defined therein. An upwards protruding boss (218) is shown surrounding the inner cavity (216) and is adapted to loosely fit within a pre-defined hole in a cook top (220). A central boss (222) is positioned on the gas supply tube (16) and has a transverse boss (224) that protrudes from the central boss (222) and has a secondary gas transfer tube (20) defined therein. The secondary gas transfer tube (20) has an inlet (228) that is adapted to receive a gas line (230).

A main gas jet (11) is placed in close proximity to the first end (204) and second end (206), where each main gas jet (11) communicates with the gas supply tube (16) in order to supply gaseous fuel to the device (1). A secondary jet (12) is shown placed on a top surface (236) of the transverse boss (224) communicating with the secondary gas transfer tube (20) thereby. The secondary jet (12) is shown enclosed on three sides by a first, second and third wall (238, 240, 242). An ignition electrode mounting plate (244) is shown having a central hole (246) defined therein. The ignition electrode mounting plate (244) is shown attached to the attachment plate (212) and the first, second and third walls (238, 240, 242 respectively).

The burner base (2) is shown resting on the mixing cup (1). Positioned above each main gas jet (11) is a primary gas mixing chamber (13). The primary gas mixing chamber (13) directs the fuel air mixture into a main burner chamber (35). The main burner chamber (35) may be any geometric shape, but as disclosed in the drawings of the instant invention, circular. An outer wall (101) of the main burner chamber (35) has a first, second, and third, series of holes (21*a*, 22*a*, 23*a*) creating a first, second, and third flame ring (21, 22, 23 respectively) defined therethrough. The first series of holes (21*a*) are larger than the second series (22*a*) and third series (23*a*) of holes and may be slots as shown in the drawings. The first series of holes or slots (21*a*) provide for a flame that produces a higher BTU range than of the second and third series of holes (22*a*, 23*a* respectively) alone. The number of flame rings that are necessary on the outer wall (101) of the main burner chamber (35) can be modified so as to provide the proper BTU capacity by revising the cross sectional area of the slot or hole (21*a*) for the main flame ring (21)

The main burner chamber (35) has at least one fourth hole or slot (24*a*) defined on an inner wall (34), which creates a fourth flame ring (24). The fourth hole or slot (24*a*) is also located on the upper portion (106) of the burner base (2). The first, second, third, series of holes (21*a*, 22*a*, 23*a* respectively), and fourth hole or slot (24*a*) all communicate with the main burner chamber (35) and provide a gas-air mixture to be ignited. The burner cap (3) is shaped similarly to the burner base (2) and covers the main burner chamber (35). The burner cap (3) therefore has a centrally located hole theredefined.

The present invention shows that the burner base (2) has a first and second secondary air slot (28, 29) defined therein, however, the burner base (2) may have one or more secondary air slots defined therein. The first and second secondary air slots (28, 29 respectively) allow food and debris to pass through. The burner base (2) further has an annular central cavity (102) defined therein, where the annular central cavity (102) is surrounded by an inner wall (34) of the burner base (2). The annular central cavity (102) communicates with the surrounding atmosphere via the first and second secondary air slots (28, 29).

The secondary burner (33) is structured as follows. A secondary transfer tube (31) is attached to a spherically convex base (30) and terminates in a end cap (32). The end cap (32) has a diameter larger than that of the secondary transfer tube (31). At the interface of the end cap (32) and the secondary transfer tube (31), a small groove (52) is defined therein. Additionally, at the interface of the end cap (32) and the secondary transfer tube (31) a fifth series of holes (25*a*) defines a fifth flame ring (25). There are at least 4 holes (25*a*) defined. The 4 holes (25*a*) communicate with the secondary transfer tube (31), and allow a fuel/air mixture to pass therethrough.

The secondary burner (33) additionally has a sixth series of holes (104) defined. The sixth series of holes (104) communicate with the secondary gas transfer tube (31) and allow the fuel/air mixture to pass therethrough adding to the fifth flame ring (25). The fuel/air mixture also is captured by the groove (52) creating a sustaining flame thereby. The secondary burner (33) is positioned over the secondary jet (12) and therefore the secondary inlet chamber (10).

With the end cap (32) having a diameter larger than the secondary transfer tube (31), the fifth series of holes (25*a*) and the small groove (52) located in the secondary transfer tube (31) will not be clogged with debris.

The secondary burner (33) has an annular ring (94) defined thereon, where the annular ring (94) fits within a corresponding annular hole (96) centrally defined within the burner base (2). The annular hole (96) is defined within conical or spherically convex base (30). The conical or spherically convex base (30) allows liquid or solid debris to be carried from the secondary burner (33) to the appliance cook top (220) and not fall through into the oven/range. Fasteners (98) securely hold the secondary burner (33) onto the burner base (2).

The main burner chamber (35) is covered by the burner cap (3). The burner cap (3) is actually an assembly and comprises multiple parts. The burner cap (3) consists of a base (74), where the base (74) is the same shape as the burner base (2). The burner cap (3) is then securely placed upon the burner base (2) and provides a leak proof fit for the gas-air mixture. The burner cap (3) generally is made from a material dense enough to provide sufficient weight to the burner cap (3) to prevent inadvertent dislocation of the burner cap (3) from the burner base (2), and to prevent the pressure within the main burner chamber (35) from dislocating the burner cap (3).

The base (74) has a downward protruding boss (76) that is adapted to fit inside the inner wall (34) of the main burner chamber (35) of the burner base (2). A plurality of upward protruding bosses (80) create a planar surface for a cover plate (6) to rest upon. The placement of the burner cap (3) on the bosses (80) creates a gap (38) between the cover plate (6) and the burner cap (3). Each boss (80) has a through hole (82) defined therethrough to allow each of a plurality of fasteners (84) to securely hold the cover plate (6) in place.

The cover plate (6) may be shaped similar to the burner base (2) and additionally has a channel (36) defined therein, which would allow a burner insert (4) to rest therein. The burner insert (4) may be made as, a complete metallic structure, or as the preferred embodiment a transparent or translucent heat resistant structure. The burner insert (4) is shown mounted upon the cover plate (6) allowing the cook to see if the flames are still burning. An advantage of using the cover plate (6) is that no direct flame is used for cooking. The flame heats the cover plate (6) which then evenly heats the cookware preventing any severe hot spots on the cookware.

The base (74) has a top side (88). Spaced between the bosses (80) is at least one flame channel (90), where each flame channel (90) has at least one through hole (92) defined therethrough. The through hole (92) communicates with the main burner chamber (35) and provides additional flame to the cookware. The drawings disclose that there are three (3) flame channels (90) spaced between the bosses (80), and each flame channel (90) has more than one through hole (92) defined therethrough.

The burner base (2) additionally has vertical flanges (40) where each vertical flange (40) has extensions (39) on their side edges that positionally locate the burner base (2) in the modified burner cup (1). The vertical flanges (40) and their extensions (39) are adapted to slide alongside the first and third walls (238, 242) of the mixing cup (1), and prevent sideways tipping of the burner base (2) over the mixing cup (1). The mixing cup (1) is secured to the cooktop or range. The mixing cup (1) has a soft seal and prevents air from entering from the interface between the cooktop and mixing cup (1). The burner base (2) is placed upon the mixing cup (1) and also sits upon the cooktop preventing air from entering the interior of the cooktop or range. This forces the burner assembly (100) to draw air from the interior of the cooktop or range.

The upwards protruding boss (218) has a first, second, third and fourth slots (248, 250, 252, 254, respectively) defined therein, where the first, second, third and fourth slots (248, 250, 252, 254 respectively) are adapted to position the vertical flanges (40) of the burner base (2) therein. The vertical flanges (40) located on the burner base (2), and their extensions (39) provide the secure centering of the primary jets (11) and therefore the primary gas flow opening (41), to the primary gas mixing chamber (13) and respectively the secondary jet (12) and secondary gas flow opening (44), to the secondary mixing chamber (14).

In order to prevent the flame exiting in close proximity of the primary gas mixing chamber (13) from larger than the surrounding flames, the burner base (2) must be modified. A gas-air transfer slot (64) is spaced between the gas-air outlets (66) located on the outer surface (68) and the inner surface (66*a*) of the burner base (2). The gas-air outlet slots (66) communicate with the gas-air transfer slot (64). Gas-air inlet slots (65) allow the main burner chamber (35) to communicate with the gas-air transfer slot (64). The gas-air inlet slots (65) are positionally offset from the gas-air outlets (66) in order to reduce the pressure gradient, thereby equalizing the outlet pressure of the gas-air mixture of first, second, and third flame rings (21, 22, 23 respectively). This creates flames of equal length around the entire outer circumference (68) of the burner base (2).

Another method of equalizing the gas pressure is as follows. The burner base (2) has a boss (110) coincidentally located over each primary gas mixing chamber (13) thus raising the point that the flammable gas-air mixture enters the main burner chamber (35). The outer wall (101) of the main burner chamber (35) has a seventh series of holes or slots (112) defined therein. The seventh series of holes or slots (112) are located in close proximity to each boss (110). The seventh series of slots (112) have cross sectional areas that is less than that of the first series of slots or holes (21*a*) defined in the burner base (2). The seventh series of holes of slots (112) is also located towards the upper portion (106) of the burner base (2). Interspaced between each of the seventh series of slots (112) is an eighth series of slots or grooves (114), the eighth series of grooves (114) allowing a flammable gas-air mixture to exit the main burner chamber (35) and provide a continuous flame for the first flame ring (21). Situated below the eighth series of grooves (114) is a ninth series of holes (116). The ninth series of holes (116) provide additional flammable gas-air for the first flame ring (21). This makes the first flame ring (21) circumferentially continuous.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An improved gas burner, comprising:

a. a mixing cup, said mixing cup has a means to provide gaseous fuel to at least two primary jets, said mixing cup further has means to provide gaseous fuel to a secondary jet;

b. a burner base, said burner base has a main burner chamber, said main burner chamber has an inner wall and an outer wall, said outer wall has at least a first series of holes or slots defining a first flame ring defined therein, said inner wall has a fourth series of holes defined therethrough said fourth series of holes having at least one hole, said burner base has a means to provide gaseous fuel to said main burner chamber, said inner wall creates a central cavity thereby, said main burner chamber has a means to communicate with said primary jet, said burner base further having a means to equalize the pressure of the exiting flammable gas-air mixture in proximity to said means to provide gaseous fuel to said main burner chamber;

c. said burner base further has a secondary burner centrally positioned within said central cavity, said secondary burner has an end cap positioned thereon, said secondary burner has a small groove defined therein, said small groove is positioned below said end cap, said secondary burner has a fifth series of holes defined therein, said fifth series of holes are positionally located within said small groove, said secondary burner is positioned above said secondary jet, said burner base has at least one secondary air slot defined therein, said secondary air slots communicate with said central cavity and provide air to said fourth and fifth holes;

d. a burner cap, said burner cap has a base, said base has a means to be positionally located onto said burner base, said burner cap further has a cover plate, said cover plate has a heat resistant portion, said cover plate is offsettedly positioned over said base and provides visual access to a fifth and fourth flames, said fifth and fourth flames are ignited from said fifth and fourth holes respectively; and e. an ignition electrode, said ignition electrode is offsettedly placed near said fifth series of holes in said secondary burner, said ignition electrode is adapted to ignite a gas-air mixture creating a fifth flame ring thereby, said gas-air mixture from said fourth series of holes is ignited from flames from the fifth flame ring, creating a fourth flame ring thereby, said main burner chamber has a series of transfer channels, said transfer channels provide communication between said main burner chamber and said secondary air slot, said secondary air slot has a smooth radiused transition, said smooth radiused transition provides an ignition flame for said first, a second, and a third series of holes, creating a first second and third flame rings thereby.

2. The improved gas burner described in claim 1 wherein said means to provide gaseous fuel to at least two primary jets comprises a gas supply tube, said gas supply tube is adapted to receive a gas supply line, said gas supply line provides flammable gas thereby.

3. The improved gas burner described in claim 1 wherein said means to provide gaseous fuel to said secondary jet comprises a secondary gas transfer tube, said secondary jet communicates with said secondary gas transfer tube allowing flammable gas to be transmitted thereby.

4. The improved gas burner described in claim 1 wherein said means to provide gaseous fuel to said main burner chamber and said means for said main burner chamber to communicate with said primary jet comprises a primary gas mixing chamber, said primary gas mixing chamber is attached to said burner base and is located above each of said primary jet, creating a gap thereby, said gap allows air to be drawn into said primary gas mixing chamber, said primary gas mixing chamber allows a flammable gas-air mixture to be transmitted therethrough and into said main burner chamber.

5. The improved gas burner described in claim 1 wherein said means of said base of said burner cap to be positionally located onto said burner base comprises a downward protruding boss, said downward protruding boss is adapted to fit inside an inner wall of said main burner chamber, said burner cap additionally has mass sufficient to prevent inadvertent dislocation from said burner base and provide a good fit to said burner base.

6. The improved gas burner described in claim 1 wherein said mixing cup is adapted to fit within a range top, said mixing cup is adapted to be fastened to the range top, said burner base is adapted to be positionally placed on said mixing cup, said burner base is offsettedly placed on said mixing cup creating a gap thereby, said gap allowing air to be drawn to said primary and said secondary inlet chambers.

7. The improved gas burner described in claim 1 wherein said means to equalize the pressure of the exiting flammable gas-air mixture comprises a boss said boss being located in said burner base and being coincidentally located over each of said primary gas mixing chamber raising the point that the flammable gas-air mixture enters said main burner chamber, said upper portion of said outer wall of said burner base additionally has a seventh series of slots or holes defined therein, said seventh series of slots being positionally located in close proximity to each of said boss, said seventh series of slots additionally having cross sectional areas less than that of said first series of slots, said upper portion of said outer wall of said burner base additionally has an eighth series of slots or grooves defined therein, said eighth series of slots or grooves being interspaced between each of said seventh series of slots said eighth series of grooves allowing the flammable gas-air mixture to exit said main burner chamber providing a continuous flame for said first flame ring thereby, said outer wall of said burner base additionally has a ninth series of holes defined therein, said ninth series of holes being positionally situated below said eighth series of grooves, said ninth series of holes providing additional flammable gas-air for said first flame ring making the first flame ring circumferentially continuous thereby.

8. An improved gas burner, comprising:

a. a mixing cup, said mixing cup is adapted to be fastened to a range top, said mixing cup has an internal cavity defined therein, said internal cavity has vertical flanges, said vertical flanges partition said internal cavity creating at least two primary and one secondary inlet chambers thereby;

b. each of said primary inlet chambers has a primary jet, said primary jet communicates with a primary gas supply tube, said gas supply tube is adapted to receive a gas supply line, allowing flammable gas to be transmitted to said primary jet thereby;

c. said secondary inlet chamber has a secondary jet, said secondary jet communicates with a secondary gas transfer tube, said secondary gas transfer tube is adapted to receive flammable gas from a secondary gas supply line;

d. said mixing cup has a hole defined therein, said hole is positionally placed near said secondary inlet chamber and is adapted to allow an ignition electrode to be placed therein, said hole is further adapted to allow a nut to secure said ignition electrode in said mixing cup;

e. a burner base, said burner base has a main burner chamber, said main burner chamber has an inner wall and an outer wall, said outer wall has at least a first series of holes or slots defining a first flame ring defined therein, said first series of holes or slots are located on an upper portion of said burner base and said outer wall, said inner wall has a fourth series of holes defined therethrough said fourth series of holes having at least one hole, said fourth series of holes are located on said upper portion of said burner base, said burner base has a means to provide gaseous fuel to said main burner chamber, said inner wall creates a central cavity thereby, said main burner chamber has a means to communicate with said primary jet, said burner base further has a hole defined therein, said hole allowing a secondary burner to be centrally positioned therein said burner base further having a means to equalize the pressure of the exiting flammable gas-air mixture in proximity to said means to provide gaseous fuel to said main burner chamber;

f. said secondary burner has a secondary transfer tube, said secondary burner is positioned above said secondary jet, said secondary burner further has an end cap positioned thereon, said secondary burner has a small groove defined therein, said small groove is positioned below said end cap, said secondary burner further has a fifth series of holes defined therein, said fifth series of holes are positionally located within said small groove, the flammable gas-air mixture communicates with said fifth series of holes via said secondary transfer tube, said burner base has at least one secondary air slot defined therein, said secondary air slot communicates with said central cavity and provides air to said fourth and fifth holes, said transfer tube has a ring defined thereon, said ring is adapted to fit within said hole of said burner base;

g. a burner cap, said burner cap has a base, said base has a means to be positionally located onto said burner base, said burner cap further has a cover plate, said cover plate has a heat resistant central portion, said cover plate is offsettedly positioned over said base and provides visual access to a fifth and a fourth flame, said fifth and fourth flames are ignited from said fifth and fourth holes respectively; and h. an ignition electrode, said ignition electrode being offsettedly placed near said fifth series of holes in said secondary burner, said ignition electrode is adapted to ignite a gas-air mixture creating a fifth flame ring thereby, said gas-air mixture from said fourth series of holes are ignited from flames from said fifth flame ring, creating a fourth flame ring thereby, said main burner chamber has a series of transfer channels, said transfer channels provide communication between said main burner chamber and said secondary air slot, said secondary air slot has a smooth radiused transition, said smooth radiused transition provides an ignition flame for said flame rings located on said outer wall of said burner base, igniting said flame rings thereby.

9. The improved gas burner described in claim 8 wherein said means to provide gaseous fuel to said main burner chamber and said means for said main burner chamber to communicate with said primary jet comprises a primary gas mixing chamber, said primary gas mixing chamber is attached to said burner base and is located above each primary jet, creating a gap thereby, said gap allows air to be drawn into said primary gas mixing chamber, said primary gas mixing chamber allows a flammable gas-air mixture to transmitted therethrough and into said main burner chamber.

10. The improved gas burner described in claim 8 wherein said means of said base of said burner cap to be positionally located onto said burner base comprises a downward protruding boss, said downward protruding boss is adapted to fit inside an inner wall of said main burner chamber, said burner cap additionally has mass sufficient to prevent inadvertent dislocation from said burner base and provides a good seal to said burner base.

11. The improved gas burner described in claim 8 wherein said base of said burner cap has a plurality of upward protruding bosses, said upward protruding bosses creates a planar surface thereby, each of said upward protruding bosses has a through hole defined therein, each of said upward protruding bosses further has means to positionally secure said cover plate, placing said burner cap on said upward protruding bosses defines a gap between said base and said burner cap, said base of said burner cap further has at least one flame channel defined therein, said flame channel is positionally spaced between said upward protruding bosses on said base, said flame channel has at least one through hole defined therein, said through hole communicates with said main burner chamber of said burner base providing additional flame thereby.

12. The improved gas burner described in claim 10 wherein said means to positionally secure said cover plate is at least one fastener.

13. The improved gas burner described in claim 8 wherein said burner base has vertical flanges, each of said vertical flanges has extensions to positionally locate said burner base to said mixing cup, each of said vertical flanges and their extensions reach into said primary air inlet chambers and prevent sideways tipping of said burner base over said mixing cup thereby, said vertical flanges and their extensions provide for secure centering of said primary jets and therefore said primary gas flow opening to said primary gas mixing chamber and respectively said secondary jet and said secondary gas flow opening to said secondary mixing chamber.

14. The improved gas burner described in claim 8 wherein said burner base is offsettedly placed from said mixing cup, creating an open air passage or primary air slot there between, said primary air slot allows air into said primary air inlet chamber.

15. The improved gas burner described in claim 8 wherein said heat resistant central portion of said burner cap is transparent.

16. The improved gas burner described in claim 8 wherein said heat resistant central portion of said burner cap is translucent.

17. The improved gas burner described in claim 8 wherein said means to equalize the pressure of the exiting flammable gas-air mixture comprises said top portion of said burner base has a gas-air transfer slot defined therein, said gas-air transfer slot being spaced between said main burner chamber and an outer surface of said burner base, said gas-air outlet being located on an outer surface and an inner surface of said burner base, said gas-air outlet slots communicate with said gas-air transfer slot, a gas-air inlet slots is defined to allow said main burner chamber to communicate with said gas-air transfer slot, said gas-air inlet slots is positionally offset from said gas-air outlets reducing the pressure gradient thereby, and equalizes the outlet pressure of the gas-air mixture of said flame rings located on said outer wall of said burner base, providing for equal length flames around the entire outer circumference of said burner base.

18. The improved gas burner described in claim 8 wherein said means to equalize the pressure of the exiting flammable gas-air mixture comprises a boss said boss being located in said burner base and being coincidentally located over each of said primary gas mixing chambers raising the point that the flammable gas-air mixture enters said main burner chamber, said upper portion of said outer wall of said burner base additionally has a seventh series of slots or holes defined therein, said seventh series of slots being positionally located in close proximity to each of said boss, said seventh series of slots additionally having cross sectional areas less than that of said first series of slots, said upper portion of said outer wall of said burner base additionally has an eighth series of slots or grooves defined therein, said eighth series of slots or grooves being interspaced between each of said seventh series of slots said eighth series of grooves allowing the flammable gas-air mixture to exit said main burner chamber providing a continuous flame for said first flame ring there by, said outer wall of said burner base additionally has a ninth series of holes defined therein, said ninth series of holes being positionally situated below said eighth series of grooves, said ninth series of holes providing additional flammable gas-air for said first flame ring making said first flame ring circumferentially continuous thereby.

19. An improved gas burner, comprising:

a. a mixing cup, said mixing cup has a gas supply line, said gas supply line is adapted to receive a gas supply tube, said gas supply tube has a first end and a second end, a first support and a second support project upwards from said gas supply tube and attach to an attachment plate, said attachment plate has an outer perimeter and an inner open cavity defined thereby;

b. an upwards protruding boss surrounds said inner open cavity, said upwards protruding boss is adapted to loosely fit within a pre-defined hole in a cook top, a central boss is positioned on said gas supply tube and has a transverse boss that protrudes from said central boss, said transverse boss has a central hole or secondary gas transfer tube defined therein;

c. said secondary gas transfer tube has an inlet, said inlet is adapted to receive a gas line;

d. a primary gas jet is positioned in close proximity to said first and second ends, where each primary gas jet communicates with said gas supply tube supplying gaseous fuel to a burner base, a secondary jet is placed on a top surface of said transverse boss, said secondary jet communicates with said secondary gas transfer tube thereby, said secondary jet is enclosed on three sides by a first, second and third wall;

e. an ignition electrode mounting plate has a central hole defined therein, said ignition electrode mounting plate is attached to said attachment plate and said first, second and third wall;

f. said burner base has a main burner chamber, said main burner chamber has an inner wall and an outer wall, said outer wall has at least a first series of holes or slots defined therein, are located on an upper portion of said burner base and said outer wall, said inner wall has a fourth series of holes defined therethrough said fourth series of holes having at least one hole, said fourth series of holes are located on said upper portion of said burner base, said burner base has a means to provide gaseous fuel to said main burner chamber, said inner wall creates a central cavity thereby, said main burner chamber has a means to communicate with said primary jet, said burner base further has a hole defined therein, said hole allows a secondary burner to be centrally positioned therein, said burner base further having a means to equalize the pressure of the exiting flammable gas-air mixture in proximity to said means to provide gaseous fuel to said main burner chamber;

g. said secondary burner has a secondary transfer tube, said secondary burner is positioned above said secondary jet, said secondary burner further has an end cap positioned thereon, said secondary burner has a small groove defined therein, said small groove is positioned below said end cap, said secondary burner further has a fifth series of holes defined therein, said fifth series of holes are positionally located within said small groove, the flammable gas-air mixture communicates with said fifth series of holes via said secondary transfer tube, said burner base has at least one secondary air slot defined therein, said secondary air slot communicates with said central cavity and provides air to said fourth and fifth series of holes, said transfer tube has a ring defined thereon, said ring is adapted to fit within said hole of said burner base;

h. a burner cap, said burner cap has a base, said base has a means to be positionally located onto said burner base, said burner cap further has a cover plate, said cover plate has a heat resistant central portion, said cover plate is offsettedly positioned over said base and provides visual access to a fifth and a fourth flame, said fifth and fourth flames are ignited from said fifth and fourth holes respectively; and an ignition electrode, said ignition electrode being offsettedly placed near said fifth series of holes in said secondary burner, said ignition electrode is adapted to ignite a gas-air mixture creating a fifth flame ring thereby, said gas-air mixture from said fourth series of holes are ignited from flames from said fifth flame ring, creating a fourth flame ring thereby, said main burner chamber has at least one transfer channel, said transfer channel provides communication between said main burner chamber and said secondary air slot, said secondary air slot further has a smooth radiused transition thereon, said smooth radiused transition provides an ignition flame for said flame rings located on said outer wall of said burner base, igniting said flame rings thereby.

20. The improved gas burner described in claim 19 wherein said means to provide gaseous fuel to said main burner chamber and said means for said main burner chamber to communicate with said primary jet comprises a primary gas mixing chamber, said primary gas mixing chamber is attached to said burner base and is located above each said primary jet, creating a gap thereby, said gap allows air to be drawn into said primary gas mixing chamber, said primary gas mixing chamber allows a flammable gas-air mixture to be transmitted therethrough and into said main burner chamber.

21. The improved gas burner described in claim 19 wherein said means of said base of said burner cap to be positionally located onto said burner base comprises a downward protruding boss, said downward protruding boss is adapted to fit inside an inner wall of said main burner chamber, said burner cap additionally has mass sufficient to prevent inadvertent dislocation from said burner base and provides a good seal to said burner base.

22. The improved gas burner described in claim 19 wherein said base of burner cap has a plurality of upward protruding bosses, said upward protruding bosses create a planar surface thereby, each of said upward protruding bosses has a through hole defined therein, each of said upward protruding bosses further has means to positionally secure said cover plate, placing said burner cap on said upward protruding bosses defines a gap between said base and said burner cap, said base of said burner cap further has at least one flame channel defined therein, said flame channel being positionally spaced between said upward protruding bosses on said base, said flame channel has at least one through hole defined therein, said through hole communicates with said main burner chamber of said burner base providing additional flame thereby.

23. The improved gas burner described in claim 22 wherein said means to positionally secure said cover plate is at least one fastener.

24. The improved gas burner described in claim 19 wherein said burner base has a plurality of vertical flanges, each of said vertical flanges has extensions to positionally locate said burner base to said mixing cup, each of said vertical flanges and their extensions reach into said primary air inlet chambers and prevent sideways tipping of said burner base over said mixing cup thereby, said vertical flanges and their extensions provide for secure centering of said primary jets and therefore said primary gas flow opening to said primary gas mixing chamber and respectively said secondary jet and said secondary gas flow opening to said secondary mixing chamber.

25. The improved gas burner described in claim 19 wherein said burner base is placed upon said mixing cup, and is adapted to prevent air from entering said mixing cup from above the range or cooktop.

26. The improved gas burner described in claim 19 wherein said heat resistant central portion of said burner cap is transparent.

27. The improved gas burner described in claim 19 wherein said heat resistant central portion of said burner cap is translucent.

28. The improved gas burner described in claim 19 wherein said means to equalize the pressure of the exiting flammable gas-air mixture comprises said outer wall having a top side, said top side of said outer wall has a gas-air transfer slot defined therein, said top side of said outer wall additionally has a gas-air outlet slot defined therein, said gas-air transfer slot communicates with said outer surface of said burner base with said gas-air outlet slots, said top side of said outer wall also having gas-air inlet slots defined therein, said gas-air transfer slot communicating with said main burner chamber with said gas-air inlet slots, said gas-air inlet slots being positionally offset from said gas-air outlet slots located on said outer surface and said inner surface of said burner base providing for equal length flames around said entire outer circumference of said burner base thereby.

29. The improved gas burner described in claim 19 wherein said means to equalize the pressure of the exiting flammable gas-air mixture comprises a boss said boss being located in said burner base and being coincidentally located over each of said primary gas mixing chambers raising the point that the flammable gas-air mixture enters said main burner chamber, said upper portion of said outer wall of said burner base additionally has a seventh series of slots or holes defined therein, said seventh series of slots being positionally located in close proximity to each of said boss, said seventh series of slots additionally having cross sectional areas less than that of said first series of slots, said upper portion of said outer wall of said burner base additionally has an eighth series of slots or grooves defined therein, said eighth series of slots or grooves being interspaced between each of said seventh series of slots said eighth series of grooves allowing the flammable gas-air mixture to exit said main burner chamber providing a continuous flame for said first flame ring thereby, said outer wall of the burner base additionally has a ninth series of holes defined therein, said ninth series of holes being positionally situated below said eighth series of grooves, said ninth series of holes providing additional flammable gas-air for said first flame ring making the first flame ring circumferentially continuous thereby.

30. The improved gas burner described in claim 1 wherein said base of said burner cap has a plurality of upward protruding bosses, said upward protruding bosses create a planar surface thereby, each of said upward protruding bosses has a through hole defined therein, each of said upward protruding bosses further has means to positionally secure said cover plate, placing said burner cap on said upward protruding bosses defines a gap between said base and said burner cap, said base of said burner cap further has at least one flame channel defined therein, said flame channel is positionally spaced between said upward protruding bosses on said base, said flame channel has at least one through hole defined therein, said through hole communicates with said main burner chamber of said burner base providing additional flame thereby.

31. The improved gas burner described in claim 30 wherein said means to positionally secure said cover plate is at least one fastener.

32. The improved gas burner described in claim 1 wherein said means to equalize the pressure of the exiting flammable gas-air mixture comprises said top portion of said burner base has a gas-air transfer slot defined therein, said gas-air transfer slot being spaced between said main burner chamber and an outer surface of said burner base, said gas-air outlet being located on an outer surface and an inner surface of said burner base, said gas-air outlet slots communicate with said gas-air transfer slot, a gas-air inlet slot is defined to allow said main burner chamber to communicate with said gas-air transfer slot, said gas-air inlet slot is positionally offset from said gas-air outlet reducing the pressure gradient thereby, and equalizes the outlet pressure of the gas-air mixture of said flame rings located on said outer wall of said burner base, providing for equal length flames around the entire outer circumference of said burner base.

33. The improved gas burner described in claim 1 wherein said heat resistant central portion of said burner cap is transparent.

34. The improved gas burner described in claim 1 wherein said heat resistant central portion of said burner cap is translucent.

* * * * *